US009458574B2

(12) United States Patent
Myangiro et al.

(10) Patent No.: US 9,458,574 B2
(45) Date of Patent: Oct. 4, 2016

(54) FIBROUS STRUCTURES

(75) Inventors: Dinah Achola Myangiro, Mason, OH (US); Douglas Jay Barkey, Hamilton Township, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1272 days.

(21) Appl. No.: 13/370,476

(22) Filed: Feb. 10, 2012

(65) Prior Publication Data

US 2013/0209749 A1 Aug. 15, 2013

(51) Int. Cl.

| | |
|---|---|
| ***D21H 27/00*** | (2006.01) |
| ***D21H 27/02*** | (2006.01) |
| ***D21F 7/08*** | (2006.01) |
| ***D21F 11/00*** | (2006.01) |
| ***D21F 11/14*** | (2006.01) |

(52) U.S. Cl.

CPC ..... *D21H 27/02* (2013.01); *D21F 7/086* (2013.01); *D21F 11/006* (2013.01); *D21F 11/14* (2013.01); *D21H 27/002* (2013.01); *Y10T 428/24628* (2015.01)

(58) Field of Classification Search

CPC ..... B32B 3/00; B32B 3/28; B32B 3/30; D21H 27/02; D21H 27/002; A47K 10/16; D21F 11/006; D21F 11/14; D21F 7/086

USPC ..... 428/156, 153, 154, 170, 172, 174, 141

See application file for complete search history.

(56) References Cited

U.S. PATENT DOCUMENTS

| | | | |
|---|---|---|---|
| 3,323,983 | A | 6/1967 | Palmer et al. |
| 3,700,623 | A | 10/1972 | Keim |
| 3,772,076 | A | 11/1973 | Keim |
| 3,974,025 | A | 8/1976 | Ayers |
| 3,994,771 | A | 11/1976 | Morgan, Jr. et al. |
| 4,011,389 | A | 3/1977 | Langdon |
| 4,191,609 | A | 3/1980 | Trokhan |
| 4,191,756 | A | 3/1980 | Masi et al. |
| 4,300,981 | A | 11/1981 | Carstens |
| 4,391,878 | A | 7/1983 | Drach |

(Continued)

FOREIGN PATENT DOCUMENTS

| | | |
|---|---|---|
| EP | 0 617 164 B1 | 8/1997 |
| EP | 1 876 291 A2 | 1/2005 |

(Continued)

OTHER PUBLICATIONS

El-Hosseiny, et al., "Effect of Fiber Length and Coarseness of the Burst Strength of Paper", TAPPI Journal, vol. 82: No. 1 (Jan. 1999), pp. 202-203.

(Continued)

*Primary Examiner* — Catherine A Simone

(74) *Attorney, Agent, or Firm* — Roddy M. Bullock

(57) ABSTRACT

A fibrous structure includes first, second, and third relatively high density wet-formed discrete elements disposed in a repeating concentric pattern. Each relatively high density wet-formed discrete element is at least partially defined by a continuous relatively low density wet-formed network that extends about an area of the fibrous structure. The first, second, and third relatively high density wet-formed discrete elements are distinguishable one from another by their respective area dimensions.

18 Claims, 7 Drawing Sheets

(56) References Cited

U.S. PATENT DOCUMENTS

| | | | |
|---|---|---|---|
| 4,440,597 | A | 4/1984 | Wells et al. |
| 4,514,345 | A | 4/1985 | Johnson et al. |
| 4,528,239 | A | 7/1985 | Trokhan |
| 4,529,480 | A | 7/1985 | Trokhan |
| 4,557,801 | A | 12/1985 | Avis |
| 4,637,859 | A | 1/1987 | Trokhan |
| 5,059,282 | A | 10/1991 | Ampulski et al. |
| 5,164,046 | A | 11/1992 | Ampulski et al. |
| 5,221,435 | A | 6/1993 | Smith, Jr. |
| 5,245,025 | A | 9/1993 | Trokhan et al. |
| 5,246,545 | A | 9/1993 | Ampulski et al. |
| 5,246,546 | A | 9/1993 | Ampulski |
| 5,275,700 | A | 1/1994 | Trokhan |
| 5,294,475 | A | 3/1994 | Mcneil |
| 5,328,565 | A | 7/1994 | Rasch et al. |
| 5,334,289 | A | 8/1994 | Trokhan et al. |
| 5,364,504 | A | 11/1994 | Smurkoski et al. |
| 5,411,636 | A | 5/1995 | Hermans et al. |
| 5,468,323 | A | 11/1995 | Mcneil |
| 5,527,428 | A | 6/1996 | Trokhan et al. |
| 5,552,345 | A | 9/1996 | Schrantz et al. |
| 5,556,509 | A | 9/1996 | Trokhan et al. |
| 5,609,725 | A | 3/1997 | Van Phan |
| 5,628,876 | A | 5/1997 | Ayers et al. |
| 5,629,052 | A | 5/1997 | Trokhan et al. |
| 5,637,194 | A | 6/1997 | Ampulski et al. |
| 5,654,076 | A | 8/1997 | Trokhan et al. |
| 5,656,132 | A | 8/1997 | Farrington, Jr. et al. |
| 5,679,222 | A | 10/1997 | Rasch et al. |
| 5,693,406 | A | 12/1997 | Wegele et al. |
| 5,709,775 | A | 1/1998 | Trokhan et al. |
| 5,716,692 | A | 2/1998 | Warner et al. |
| 5,795,440 | A | 8/1998 | Ampulski et al. |
| 5,804,281 | A | 9/1998 | Phan et al. |
| 5,858,554 | A | 1/1999 | Neal et al. |
| 5,865,950 | A | 2/1999 | Vinson et al. |
| 5,900,122 | A | 5/1999 | Hus-ton |
| 5,906,710 | A | 5/1999 | Trokhan |
| 5,935,381 | A | 8/1999 | Trokhan et al. |
| 5,938,893 | A | 8/1999 | Trokhan et al. |
| 5,942,085 | A | 8/1999 | Neal et al. |
| 6,030,690 | A | 2/2000 | Mcneil et al. |
| 6,048,938 | A | 4/2000 | Neal et al. |
| 6,086,715 | A | 7/2000 | Mcneil |
| 6,113,723 | A | 9/2000 | Mcneil et al. |
| 6,165,319 | A | 12/2000 | Heath et al. |
| 6,187,138 | B1 | 2/2001 | Neal et al. |
| 6,193,839 | B1 | 2/2001 | Ampulski et al. |
| 6,238,682 | B1 | 5/2001 | Klofta et al. |
| 6,458,447 | B1 | 10/2002 | Cabell et al. |
| 6,673,202 | B2 | 1/2004 | Burazin et al. |
| 6,706,152 | B2 | 3/2004 | Burazin et al. |
| 6,746,570 | B2 | 6/2004 | Burazin et al. |
| 6,746,766 | B2 | 6/2004 | Bond et al. |
| 6,749,719 | B2 | 6/2004 | Burazin et al. |
| 6,787,000 | B2 | 9/2004 | Burazin et al. |
| 6,790,314 | B2 | 9/2004 | Burazin et al. |
| 6,797,114 | B2 | 9/2004 | Hu |
| 6,802,937 | B2 | 10/2004 | Johnston et al. |
| 6,821,385 | B2 | 11/2004 | Burazin et al. |
| 6,890,872 | B2 | 5/2005 | Bond et al. |
| 6,946,506 | B2 | 9/2005 | Bond et al. |
| 7,419,569 | B2 | 9/2008 | Hermans et al. |
| 7,494,563 | B2 | 2/2009 | Edwards et al. |
| 7,687,140 | B2 | 3/2010 | Manifold et al. |
| 7,704,601 | B2 | 4/2010 | Manifold et al. |
| 7,807,022 | B2 | 10/2010 | Hermans et al. |
| 7,811,665 | B2 | 10/2010 | Manifold et al. |
| 7,939,168 | B2 | 5/2011 | Manifold et al. |
| 7,960,020 | B2 | 6/2011 | Manifold et al. |
| 7,989,058 | B2 | 8/2011 | Manifold et al. |
| 8,025,966 | B2 | 9/2011 | Manifold et al. |
| 2002/0168518 | A1 | 11/2002 | Bond et al. |
| 2003/0077444 | A1 | 4/2003 | Bond et al. |
| 2003/0092343 | A1 | 5/2003 | Bond et al. |
| 2003/0138597 | A1 | 7/2003 | Ruthven et al. |
| 2003/0168912 | A1 | 9/2003 | Wodrich et al. |
| 2004/0023003 | A1 | 2/2004 | Basler et al. |
| 2004/0112783 | A1 | 6/2004 | Mukai et al. |
| 2004/0154767 | A1 | 8/2004 | Trokhan et al. |
| 2004/0154768 | A1 | 8/2004 | Trokhan et al. |
| 2004/0154769 | A1 | 8/2004 | Lorenz et al. |
| 2004/0157524 | A1 | 8/2004 | Polat et al. |
| 2004/0192136 | A1 | 9/2004 | Gus-ky et al. |
| 2004/0258887 | A1 | 12/2004 | Maciag et al. |
| 2004/0261639 | A1 | 12/2004 | Vaughn et al. |
| 2005/0026529 | A1 | 2/2005 | Bond |
| 2005/0034828 | A1* | 2/2005 | Graff et al. ..... 162/123 |
| 2005/0045293 | A1 | 3/2005 | Hermans et al. |
| 2005/0067126 | A1 | 3/2005 | Horenziak et al. |
| 2005/0079785 | A1 | 4/2005 | Bond et al. |
| 2005/0178513 | A1 | 8/2005 | Russell et al. |
| 2005/0201965 | A1 | 9/2005 | Kuhlman et al. |
| 2006/0137840 | A1* | 6/2006 | Burazin et al. ..... 162/109 |
| 2007/0232178 | A1 | 10/2007 | Polat et al. |
| 2008/0041543 | A1 | 2/2008 | Dyer et al. |
| 2008/0260996 | A1 | 10/2008 | Heilman et al. |
| 2009/0220741 | A1 | 9/2009 | Manifold et al. |
| 2009/0220769 | A1 | 9/2009 | Manifold et al. |
| 2010/0294446 | A1 | 11/2010 | Manifold et al. |
| 2011/0027563 | A1 | 2/2011 | Manifold et al. |
| 2011/0183132 | A1 | 7/2011 | Manifold et al. |
| 2011/0189435 | A1 | 8/2011 | Manifold et al. |
| 2011/0189436 | A1 | 8/2011 | Manifold et al. |
| 2011/0189442 | A1 | 8/2011 | Manifold et al. |
| 2011/0189443 | A1 | 8/2011 | Manifold et al. |
| 2011/0189451 | A1 | 8/2011 | Manifold et al. |
| 2011/0206913 | A1 | 8/2011 | Manifold et al. |
| 2011/0253329 | A1 | 10/2011 | Manifold et al. |
| 2011/0305884 | A1 | 12/2011 | Manifold et al. |

FOREIGN PATENT DOCUMENTS

| | | | |
|---|---|---|---|
| EP | 1 505 207 | A2 | 2/2005 |
| EP | 0 677 612 | B2 | 6/2006 |
| GB | 2319539 | A | 5/1998 |
| WO | WO 96/33310 | A1 | 10/1996 |
| WO | WO 97/17494 | A1 | 5/1997 |
| WO | WO 98/44194 | A1 | 10/1998 |
| WO | WO 2005/021868 | A1 | 3/2005 |
| WO | WO 2005/068720 | A1 | 7/2005 |
| WO | WO 2005/080683 | A2 | 9/2005 |
| WO | WO 2006/060814 | A2 | 6/2006 |
| WO | WO 2007/001576 | A1 | 1/2007 |
| WO | WO 2007/070124 | A1 | 6/2007 |

OTHER PUBLICATIONS

Smook, Gary A., Second Edition Handbook for Pulp & Paper Technologists, 1992, Angus Wilde Publications, Chapter 13, pp. 194-208.

US 5,972,466, 10/1999, Trokhan (withdrawn)

* cited by examiner

FIBROUS STRUCTURES

FIELD

The present disclosure generally relates to fibrous structures and, more particularly, relates to fibrous structures comprising discrete elements situated in specified spatial arrangement patterns.

BACKGROUND

Cellulosic fibrous structures are a staple of everyday life. Cellulosic fibrous structures are used as consumer products for paper towels, toilet tissue, facial tissue, napkins, and the like. The large demand for such paper products has created a demand for improved versions of the products and the methods of their manufacture.

Consumers prefer cellulosic fibrous structures such as toilet tissue and paper towels having multiple attributes, including softness, absorbency, strength, flexibility, and bulk. To produce such cellulosic fibrous products the fibrous structure should exhibit a functional balance of parameters such as resistance and resilience, high capillary, high permeability, rigidity and flexibility. Consumers also prefer cellulosic fibrous structures exhibiting durable, cloth-like performance. Specifically durable, cloth-like performance refers to the ability of a product such as a paper towel to be durable and hold up in wet state usage and yet remain thick, flexible and soft in dry state usage. Substantiality can refer to high in-use wet caliper and high force to gather. These attributes may communicate to the consumer that the product will be useful for a variety of cleaning tasks. Moreover, these attributes can communicate that the product will not only last throughout the first cleaning process retaining its physical integrity but also last into the next task.

There is a continuing unmet consumer need for a product having improved in-use wet state substantiality and therefore an improved impression of strength and durability without sacrificing dry state tactile feel and absorbency performance.

Additionally, there in an unmet consumer need for a fibrous structure product with enhanced wet state substantiality as defined by wet bulk and x-y resistance while also providing other consumer-pleasing attributes such as absorbency, and softness.

Further, there in an unmet consumer need for a fibrous structure that exhibits functional equilibrium for both wet state substantiality and x-y plane force to gather.

SUMMARY OF INVENTION

A fibrous structure is disclosed. The fibrous structure includes a plurality of relatively high density wet-formed discrete elements each at least partially defined by a substantially continuous relatively low density wet-formed network that extends about an area of the fibrous structure. The plurality of relatively high density discrete elements are disposed in a repeating concentric pattern defined from the inside of the pattern to the outside of the pattern by a first central relatively high density discrete element having a first area dimension. A second plurality of relatively high density discrete elements surrounds the first central relatively high density discrete element, each relatively high density discrete element of the second plurality of relatively high density discrete elements having a second area dimension. A third plurality of relatively high density discrete elements surrounds the second plurality of relatively high density discrete elements, each relatively high density discrete element of the third plurality of relatively high density discrete elements having a third area dimension.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
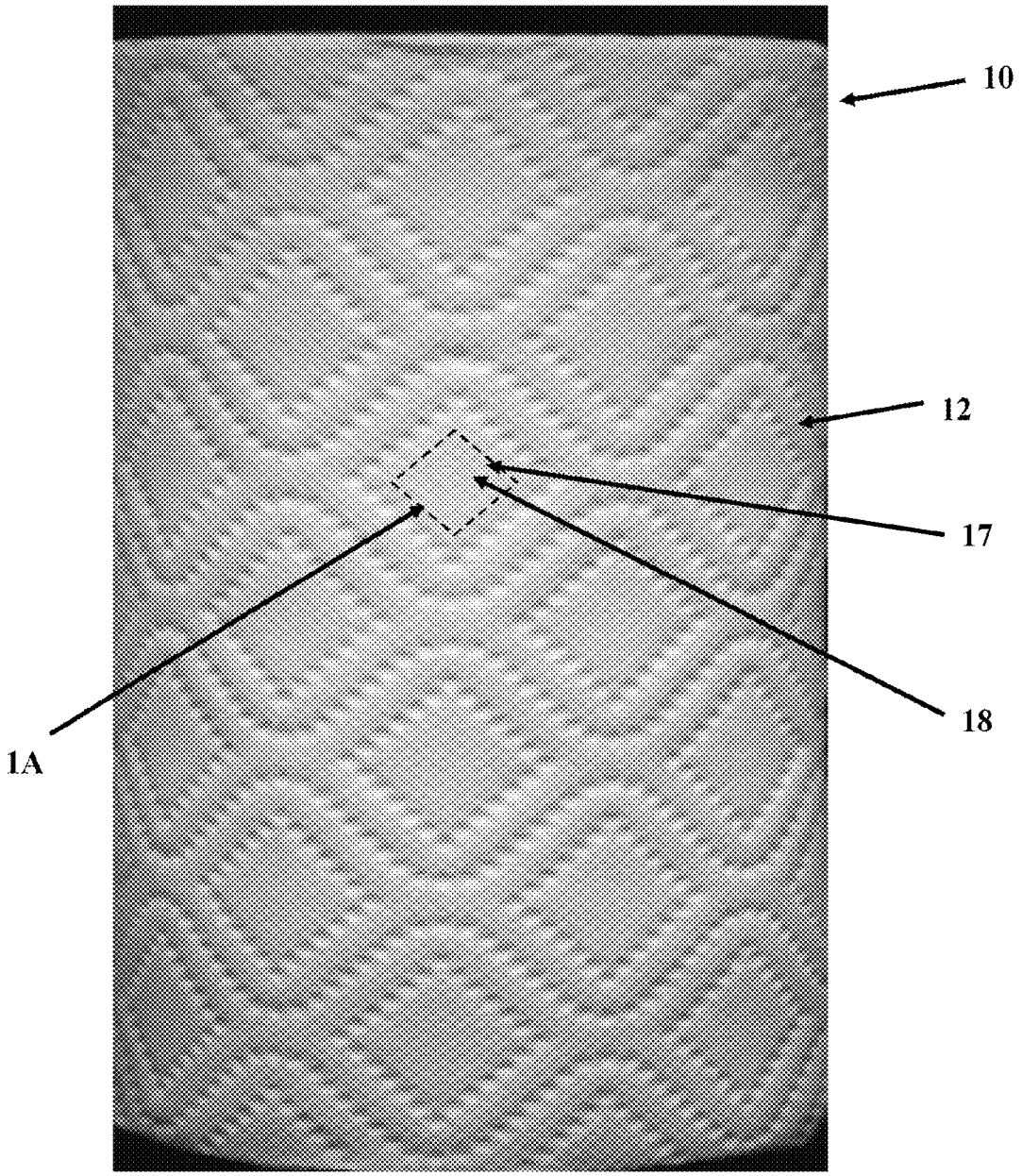
FIG. 1 is a front perspective view of a roll of one embodiment of a fibrous structure in accordance with the present invention.
Figure 1A:
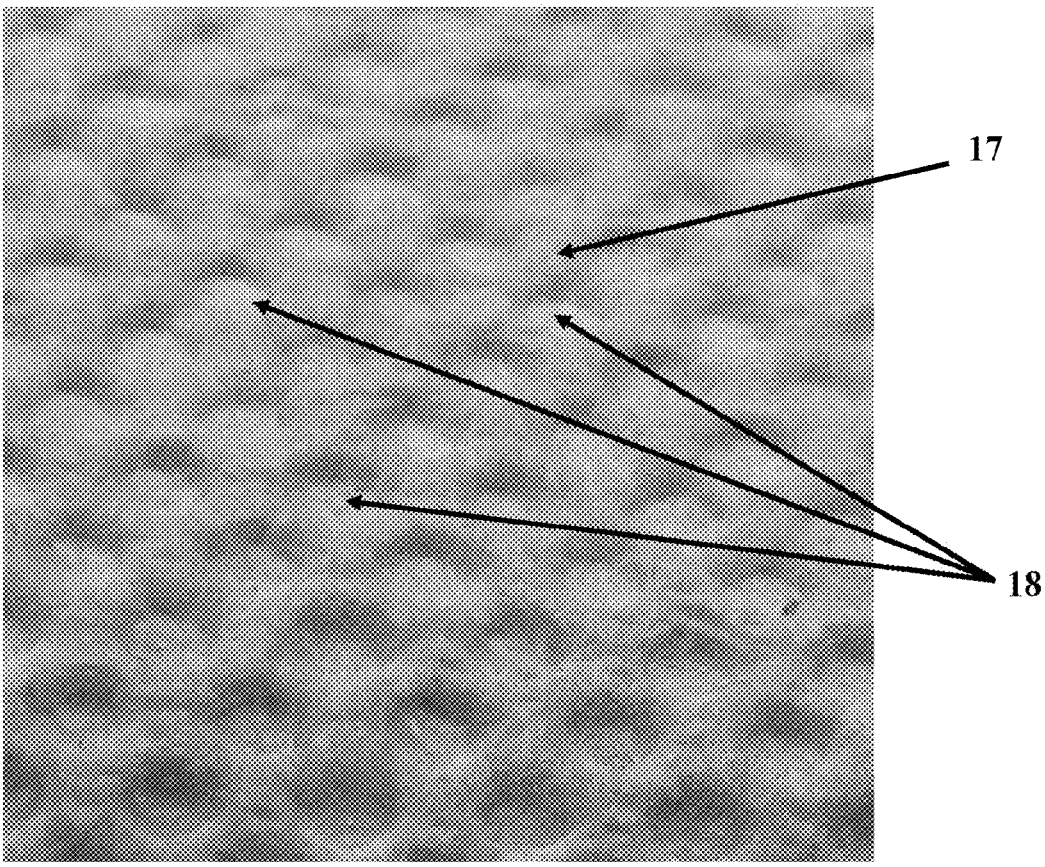
FIG. 1A is an enlarged photographic view of portion 1A from FIG. 1.

The present invention, in an embodiment, relates to a single or multiply fibrous structure product comprising: one or more plies of fibrous structure comprising discrete high density elements of mixed sizes spatially arranged in non random, concentric pattern either in ascending, descending or alternating order of element sizes, determined by area. The plurality of relatively high density discrete elements can be disposed in a repeating concentric pattern defined from the inside of the pattern to the outside of the pattern by a first central discrete element having first area dimension, a second plurality of discrete elements surrounding the first central discrete element, each discrete element of the second plurality of discrete elements having a second area dimension, and a third plurality of discrete elements surrounding the second plurality of discrete elements, each discrete element of the third plurality of discrete elements having a third area dimension.

The latter is purposefully done to create varying fiber distribution densities in the continuous relative low density regions of the fibrous structure. The concentric spatial arrangement of the various element sizes can comprise a single ring or multiple rings. The single unit forming the repeating spatial arrangement design can be of any geometrical shape, including symmetric or asymmetric shapes. The fibrous structure can have a x-y plane force to gather (cm/lbs/3000 $ft^2$) of between about 0.33 to about 0.40, Z-direction compression resistance (mils/lbs/3000 $ft^2$) of between about 0.96 to about 1.20, absorbency capacity (g/sq in) of from about 0.62 to about 0.71 CRT Max (g/s)*s) of from about 5.75 to 6.40, and an absorbency rate measure by SST_2-15 (g/sec0.5) of from about 1.55 to about 2.00.

Definitions

As used herein, "paper product" refers to any wet-formed, fibrous structure product, traditionally, but not necessarily, comprising cellulose fibers. In one embodiment, the paper products of the present invention include tissue-towel paper products, including toilet tissue and paper towels.

A "tissue-towel paper product" refers to products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the fibers may or may not be homogenous within a layer. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

The term "fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Basis Weight", as used herein, is the weight per unit area of a sample reported in lbs/3000 $ft^2$ or $g/m^2$.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Sheet Caliper" or "Caliper", as used herein, means the macroscopic thickness of a product sample under load.

"Patterned densified", as used herein, means a portion of a fibrous structure product that is characterized by having a relatively high-bulk field of relatively low fiber density and an array of densified zones of relatively high fiber density. The high-bulk field is alternatively characterized as a field of relatively high-density, densified, knuckle regions discretely spaced apart by a continuous field of a relatively low-density, non-densified, pillow region. The densified zones may be discretely spaced within the high-bulk field or may be interconnected (and e.g. continuous), either fully or partially, within the high-bulk field. One embodiment of a method of making a pattern densified fibrous structure and devices used therein are described in U.S. Pat. Nos. 4,529,480 and 4,528,239.

"Densified", as used herein, means a portion of a fibrous structure product that exhibits a higher density than another portion of the fibrous structure product.

"Non-densified", as used herein, means a portion of a fibrous structure product that exhibits a lesser density than another portion of the fibrous structure product.

"Bulk Density", as used herein, means the apparent density of an entire fibrous structure product rather than a discrete area thereof.

"Laminating" refers to the process of firmly uniting superimposed layers of paper with or without adhesive, to form a multi-ply sheet.

"Non-naturally occurring" as used herein means that the fiber is not found in nature in that form. In other words, some chemical processing of materials needs to occur in order to obtain the non-naturally occurring fiber. For example, a wood pulp fiber is a naturally occurring fiber, however, if the wood pulp fiber is chemically processed, such as via a lyocell-type process, a solution of cellulose is formed. The solution of cellulose may then be spun into a fiber. Accordingly, this spun fiber would be considered to be a non-naturally occurring fiber since it is not directly obtainable from nature in its present form.

"Naturally occurring fiber" as used herein means that a fiber and/or a material is found in nature in its present form. An example of a naturally occurring fiber is a wood pulp fiber.

Fibrous Structures

The fibrous structures of the present disclosure can be single-ply or multi-ply fibrous structures and can comprise cellulosic pulp fibers. Other naturally-occurring and/or non-naturally occurring fibers can also be present in the fibrous structures. In one example, the fibrous structures can be throughdried, or "through air dried (TAD)". In one example, the fibrous structures can be wet-laid fibrous structures. The fibrous structures can be incorporated into single- or multi-ply sanitary tissue products. The sanitary tissue products or fibrous structures can be in roll form where they are convolutedly wound or wrapped about themselves with or without the employment of a core. In other embodiments, the sanitary tissue products or fibrous structures can be in sheet form or can be at least partially folded over themselves. Fibrous structures of the present invention can have basis weights in the range of 15 lbs/3000 $ft^2$ to 30 lbs/3000 $ft^2$ per ply, or 30 or lbs/3000 $ft^2$, 40 lbs/3000 $ft^2$, 50 lbs/3000 $ft^2$, or 60 lbs/3000 $ft^2$ for 2-ply structures.

Those of skill in the art will recognize that although the figures illustrate various examples of fibrous structures, sanitary tissue products, patterns, and papermaking belts of the present disclosure, those fibrous structures, sanitary tissue products, patterns, and papermaking belts are merely examples and are not intended to limit the present disclosure. Many other fibrous structures or sanitary tissue products having irregular patterns of discrete elements can also be used to achieve the benefits and advantages of the fibrous structures or sanitary tissue products of the present disclosure. The fibrous structures or sanitary tissue products of the present disclosure can apply to flat fibrous structures or sanitary tissue products, non-rolled fibrous structures or sanitary tissue products, folded fibrous structures or sanitary tissue products, and/or any other suitable formation for fibrous structures or sanitary tissue products.

The fibrous structures of the present invention can be made by using a patterned papermaking belt for forming three-dimensionally structured wet-laid webs as described in U.S. Pat. No. 4,637,859, issued Jan. 20, 1987, to Trokhan. Broadly, the papermaking belt of the present invention includes a reinforcing element (such as a woven belt) which can be thoroughly coated with a liquid photosensitive polymeric resin to a preselected thickness. A film or negative incorporating the pattern desired is juxtaposed on the liquid photosensitive resin. The resin is then exposed to light of an appropriate wave length through the film. This exposure to light causes curing of the resin in the exposed areas (i.e., white portions or non-printed portions in the film). Unexposed (and uncured) resin (under the black portions or printed portions in the film) is removed from the system leaving behind the cured resin forming the pattern desired, which pattern transfers during the wet-forming phase of papermaking to the fibrous structure.

The present invention embodies a new patterned papermaking belt of the general type taught by Trokhan '859, which produces new fibrous structures having novel properties as described herein.

FIG. 1 illustrates one embodiment of a fibrous structure 10 as a rolled product 12. FIG. 1 illustrates a roll of a fibrous structure 12 having a continuous or substantially continuous relatively low density network 16 at least partially or fully defining or surrounding a plurality of relatively high density discrete elements 18 situated in a regular pattern. The continuous or substantially continuous relatively low density network can be said to form a continuous or substantially continuous "pillow" region in the fibrous structure, while the relatively high density discrete elements can be said to form "knuckle" regions in the fibrous structure.

The fibrous structure of FIG. 1 can be formed using a patterned papermaking belt 200 having a plurality of discrete raised portions 14, each discrete raised portions 14 forming a corresponding discrete element 18 on fibrous structure 10. Each discrete element 18 can be surrounded by a continuous non-densified low density network 17, or pillow region, the non-densified low density network 17 formed by the substantially continuous deflection conduit 16 of papermaking belt 200.

Figure 2:
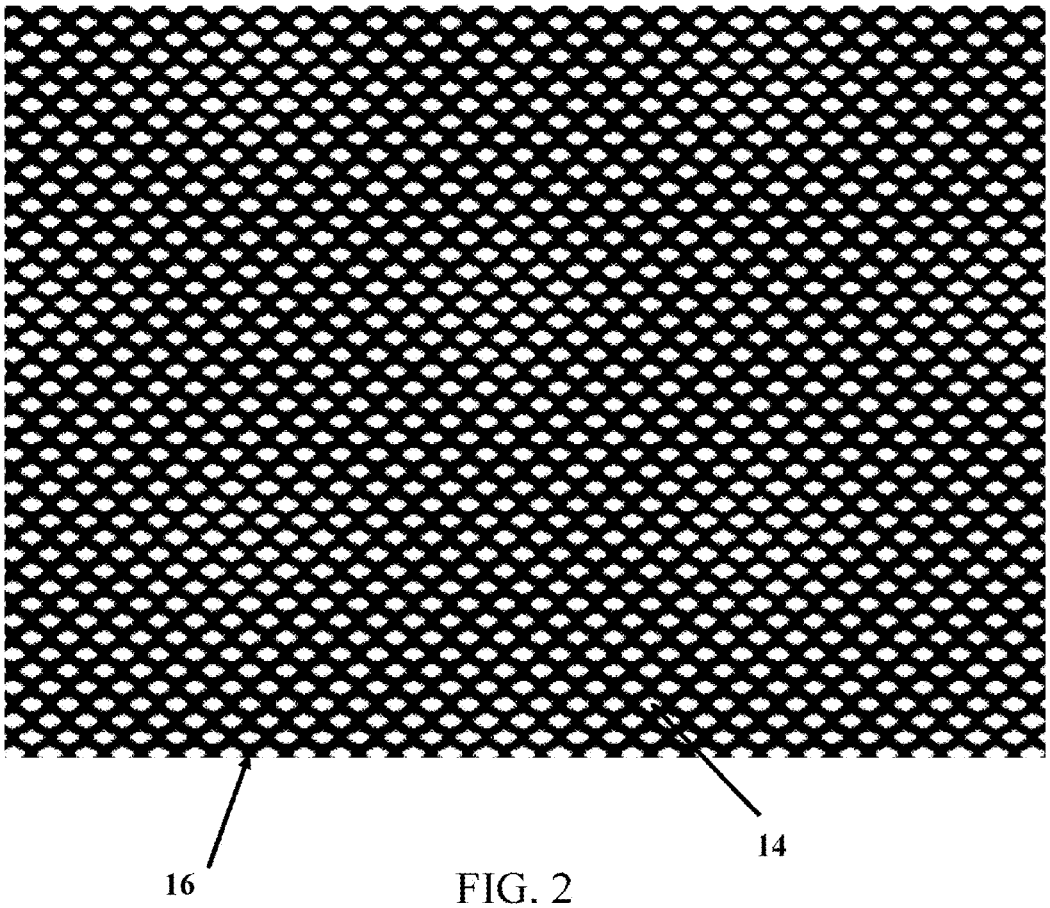
FIG. 2 is an illustration of a portion of an embodiment of a pattern used to make the molding member for making a fibrous structure of the present invention.

Each discrete raised portion 14 of papermaking belt 200 can be defined by a substantially continuous deflection conduit 16, cured from a patterned film 15 as shown in FIG. 2. Any portion of the patterned film 15 shown in FIG. 2 that is black represents a portion of the patterned papermaking belt which is substantially resin free, and, which during papermaking forms relatively low density, non-densified areas in a fibrous structure, while any portion of the pattern that is white represents a portion of patterned papermaking belt where resin was cured, and which can be used to form a relatively high density areas in the fibrous structure 10. This inverse relation (black/white) can apply to all patterns of the present disclosure, although all fibrous structures/patterns of each category are not illustrated for brevity since the concept is illustrated in FIGS. 1 and 2, and further disclosed in more detail below.

Figure 4:
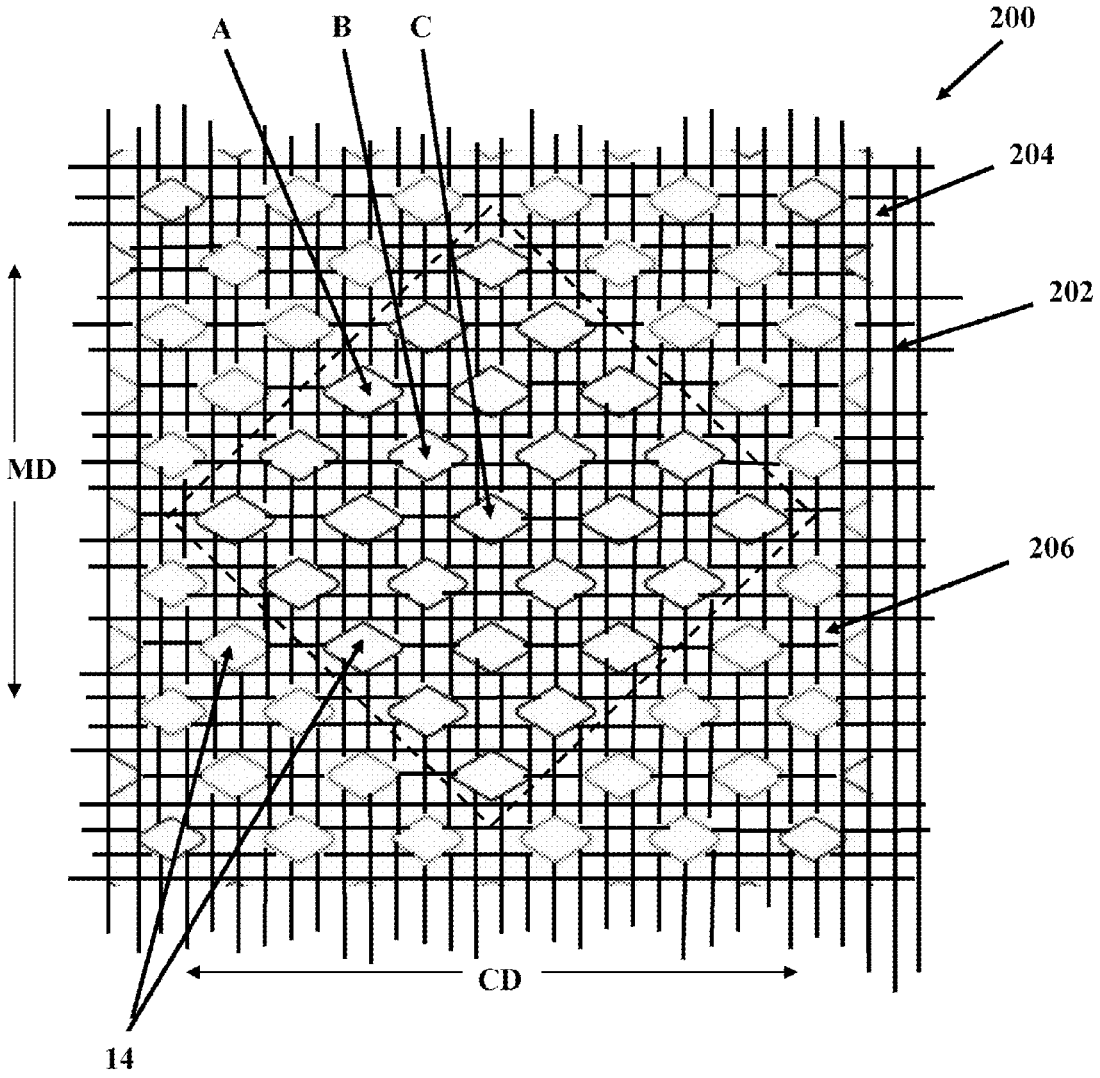
FIG. 4 is a plan view of a portion of a molding member papermaking belt of the present invention.

The pattern of FIG. 2 can be used to form a papermaking belt as shown in FIG. 4, having a plurality of discrete raised portions 14 extending from the reinforcing element 202 on the papermaking belt 200, wherein the discrete raised portions 14 can be surrounded by a substantially continuous deflection conduit 16. The papermaking belts of the present disclosure and the process of making them are described in further detail below.

The pattern of FIG. 2 can be printed on a transparent or semi-transparent film used to create a papermaking belt according to the teachings of the above-mentioned Trokhan '859 patent. As disclosed in Trokhan '859, depending on the pattern, the black portions (or printed portions) create a plurality of deflection cells or one or more continuous or substantially continuous deflection conduits 16 (i.e., no resin or other material extending from a reinforcing member) in a papermaking belt. Likewise, the white portions (transparent, non-printed portions) create a plurality of discrete raised portions 14 or one or more continuous or substantially continuous members (i.e., resin or other material extending from a reinforcing member) on the papermaking belt. In essence, the film is positioned over a layer of photocurable resin or other material situated on a reinforcing element, such as a wire mesh. A light source is then projected onto the film. The light source passes through portions of the film in the white areas and does not pass through the film in the black areas. The light source that passes through the white areas at least partially cures (i.e., hardens) the resin under the white portions in the film, while the resin under the black portions remains uncured or at least mostly uncured since no light passed to that portion of the resin. The uncured resin (under the black portions) is then washed off of the reinforcing element of the papermaking belt, thereby leaving behind a plurality of discrete deflection cells or one or more continuous or substantially continuous deflection conduits 16 (no resin) and one or more continuous or substantially continuous members or a plurality of discrete raised portions 14, depending on the positioning of the black portion/white portion.

When a fibrous slurry is deposited onto the papermaking belt, a three-dimensional fibrous structure is formed. To dry the fibrous structure, the fibrous structure can be fed around a Yankee dryer and then creped (or removed from the Yankee dryer) with a doctor blade. In some embodiments, the fibrous structure can be dried with or without a Yankee dryer, and with or without creping. The resulting fibrous structure can have areas of relatively high density (where the resin deposits were present on the papermaking belt) and areas of relatively low density (where the resin deposits were not present on the papermaking belt). This fibrous structure-making process is described in greater detail below, but is discussed here to set forth the general process for clarity in illustration.

Figure 3:
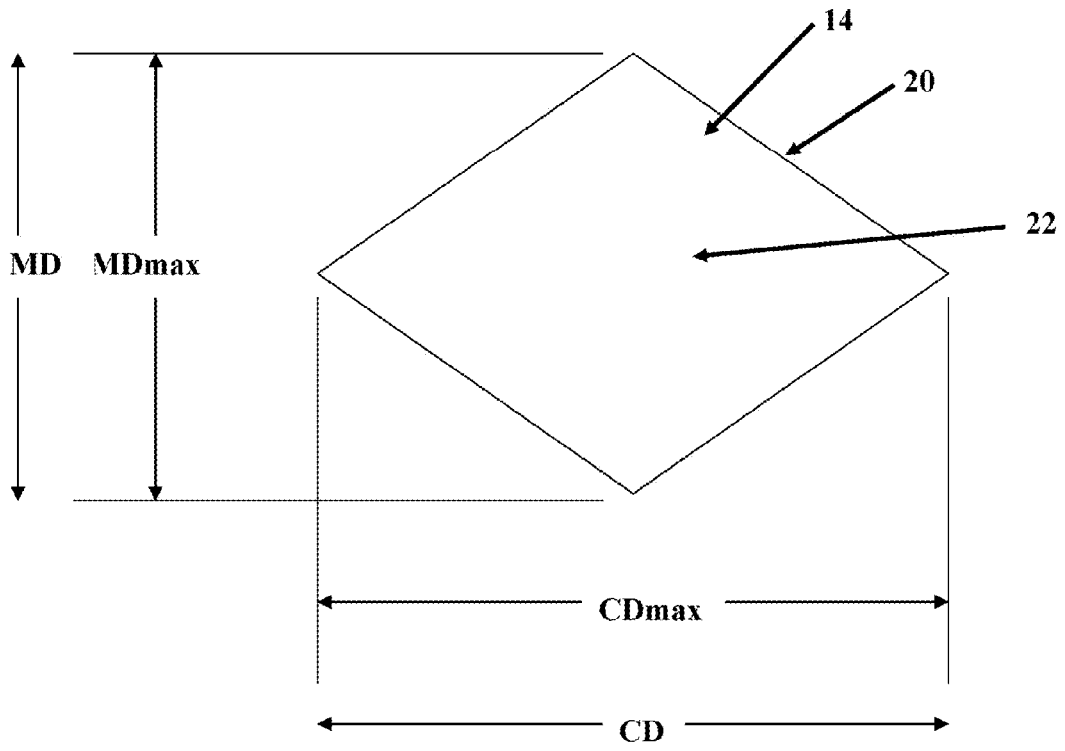
FIG. 3 is plan view of an example of a discrete raised portion of a molding member for making a fibrous structure of the present invention.

In one embodiment, referring to FIG. 3, each individual discrete raised portion 14 on a papermaking belt, or each individual discrete element 18 of a fibrous structure (illustrated without the belt or the fibrous structure, respectively, for clarity), can be any shape, but can have a generally elongated shape having a major axis, CDmax, and a minor axis, MDmax. As shown in FIG. 3, individual discrete raised portions 14 can have a rhomboid shape. In general, the dimensions of the discrete elements 18 of the fibrous structure 12 are determined by the dimensions of the corresponding discrete raised portions 14 that formed them. That is, the fibrous structure is generally formed over the three-dimensional structure of the papermaking belt, so that in one sense the fibers are formed over, or molded to, the discrete raised portions 14. In either case, whether discrete raised portion 14 or discrete element 18, the ratio of the length major axis, CDmax, to the length of the minor axis, MDmax, can be greater than or equal to one. Stated another way, the major axis, CDmax, can be longer than or can have the same length as the minor axis, MDmax. In one embodiment, the ratio of the length of the major axis, CDmax, to the length of the minor axis, MDmax, can be in the range of 1 to about 3 or in the range of 1 to about 4 or more. For example, the ratio of the length of the major axis, CDmax, to the length of the minor axis, MDmax, can be 1, 1.5, 2, 2.5, 3, 3.5, 4, 4.5, or 5.

Discrete raised portions 14 can have a generally flat top surface, the top surface 22 being the surface furthest away from the reinforcing element (as shown in more detail in FIG. 4), and can have an area, which, as shown in FIG. 3, is the area of the top surface presented in plan view within the boundaries of the perimeter 20 of each discrete raised portion 14. Area can be determined mathematically based on known geometric properties or calculated based on the visually perceptible perimeter 20.

Papermaking Belts

The fibrous structure of the present invention exhibits improved performance and will be described in detail below. As discussed above, the fibrous structure is made on a papermaking belt having a structure as described herein. Previous papermaking belts of the type disclosed in U.S. Pat. Nos. 5,654,076, 5,804,281, and 6,193,839 describe papermaking belts having discrete raised portions 14 of the type utilized in the present invention. Each disclosure of such belts, such as the disclosure in FIGS. 6 and 7 of U.S. Pat. No. 5,804,281 (showing discrete elements 59) or FIGS. 10 and 11 of U.S. Pat. No. 6,193,839 (showing discrete elements 222) show regular patterns of discrete elements having regular size and regular spacing. The papermaking belt of the present invention exhibits a pattern of discrete elements having different sizes. The differently sized discrete elements can be disposed in a pattern that also includes different dimensions for the spacing between discrete elements, i.e., the width of the deflection conduit 16 separating discrete elements 14.

Figure 5:
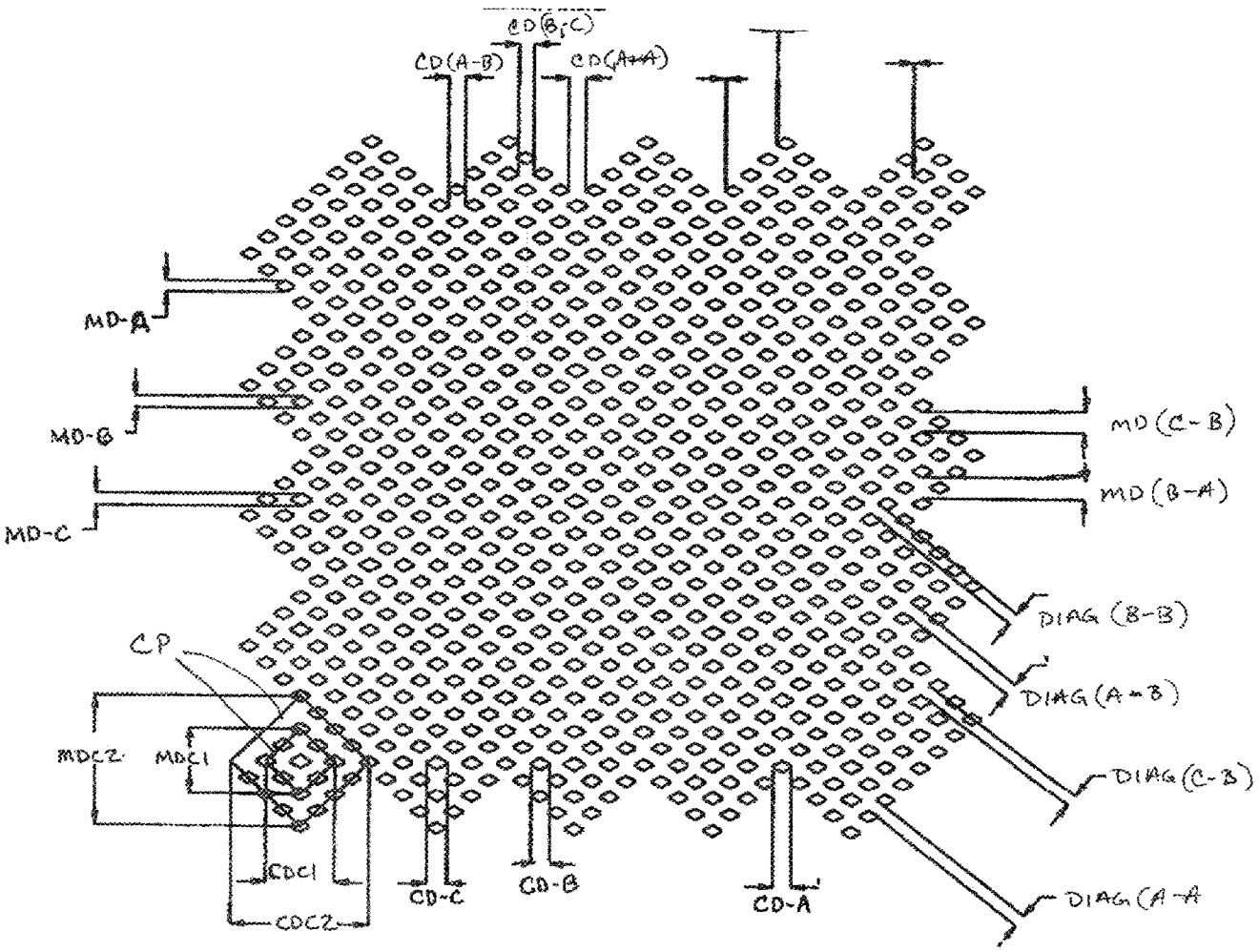
FIG. 5 is a plan view of a portion of a molding member papermaking belt of the present invention.

In one embodiment, referring to FIGS. 4 and 5, a portion of a papermaking belt 200 (also referred to as a molding member) that can be used to manufacture the fibrous structures of the present disclosure is illustrated. FIG. 4 is a top view showing one repeating unit 206 (shown by dashed line) of one example of a pattern of the papermaking belt 200. A larger portion comprising multiple repeat units is shown in FIG. 5.

The papermaking belt 200 can comprise a reinforcing element 202, such as a porous wire mesh, comprising a surface 204. A plurality of discrete raised portions 14 can extend from portions of the surface 204 of the reinforcing element 202. The discrete raised portions 14 can be situated or arranged in a regular pattern. The papermaking belt 200 can further comprise a continuous or substantially continuous deflection conduit 16 at least partially defining or surrounding at least some of or all of the discrete raised portions 14. The relatively high density discrete elements of the fibrous structures described herein can be formed on the discrete raised portions 14 and the substantially continuous relatively low density network of the fibrous structures described herein can be formed on the continuous or substantially continuous deflection conduit 16. The discrete raised portions 14 can correspond to white areas in the patterns on the films described in FIG. 2, while the continuous or substantially continuous deflection conduit 16 can correspond to black areas in the patterns on the films described in FIG. 2.

Each of the discrete raised portions 14 can have a minor axis, MDmax, which can be oriented in the machine direction (MD) of the papermaking belt, and a major axis, CDmax, which can be oriented in the cross machine direction (CD).

As shown in FIG. 4, a repeat unit 206 of the present invention can have concentrically oriented discrete raised portions 14, with each "ring" of the concentricity comprising discrete raised portions 14 of a predetermined size. The size is expressed as an area circumscribed by the perimeter 20 of a discrete raised portion 14 as viewed in plan view, as shown in FIG. 3. That is, as discussed above, the "area dimension" of discrete raised portions 14 is the area of the top 22 of the discrete raised portion 14 viewed in plan view. The area dimensions of discrete raised portions 14 of the papermaking belt 200 correspond substantially identically to the area dimensions of the clear portions of a patterned film (shown as the white portions of the pattern of FIG. 2).

In FIG. 4, central discrete raised portion 14 "C" has a first area dimension as shown in Table 1 below. Surrounding central discrete raised portion 14 C are eight discrete raised portions 14 "B" each having an area dimension as shown in Table 1 below. Surrounding discrete raised portion 14 B are sixteen discrete raised portions 14 "A" each having an area dimension as shown in Table 1 below. As illustrated in FIG. 4, therefore, one embodiment of a repeat pattern of a papermaking belt of the present invention has discrete raised portions 14 disposed in a repeating concentric, geometrically shaped pattern defined from the inside of the pattern to the outside of the pattern by one discrete raised portion 14 (or a first set of central discrete raised portions 14) each having a first area dimension, a second plurality of discrete raised portions 14 surrounding the first central discrete raised portions 14, each element of the second plurality of discrete raised portions 14 having a second area dimension, and a third plurality of discrete raised portions 14 surrounding the second plurality of discrete raised portions 14, each discrete raised portions 14 of the third plurality of elements having a third area dimension.

FIG. 5 illustrates an embodiment of a pattern of discrete raised portions 14 of a papermaking belt. In FIG. 5 the discrete raised portions 14 are shown as generally rhomboid-shaped without the reinforcing element, for clarity. FIG. 5 shows the dimensions of interest for a papermaking belt of the present invention, which makes a fibrous structure of the present invention having similar dimensions, taking into account the thickness (caliper) of the fibrous structure as it molds around the discrete raised portions 14.

As shown in FIG. 5, each discrete raised portion 14 has a major axis dimension measured in the CD and a minor axis dimension measured in the MD. Also as shown on FIG. 5, the substantially continuous deflection conduit 16 can be characterized by three dimensions, i.e., a CD spacing, an MD spacing, and a diagonal spacing (DIAG). Because the discrete raised portions 14 of the present invention can have different sizes, they are denoted on FIG. 5 as A, B, and C, with A being the smallest in area dimension, B being larger in area dimension than A, and C being larger in area dimension than B.

The discrete raised portions 14 in FIG. 5 are disposed in a concentric pattern as indicated by the lines at CP, and having a range of dimensions as indicated. FIG. 5 shows a "uni-concentric" pattern, that is, a pattern in which there is one "ring" of B-size discrete raised portions 14 surrounding a single C-size discrete raised portion. The ring of B-size discrete raised portions 14 can be non-circular, and can be generally rhomboid-shaped, as shown in FIG. 5, with an innermost ring having an MD dimension of MDC1 and a CD dimension of CDC1. Likewise, in a uni-concentric arrangement, a single "ring" of A-size discrete raised portions 14 can surround the ring of B-size discrete raised portions 14. The ring of A-size discrete raised portions 14 can be non-circular, and can be generally rhomboid-shaped, as shown in FIG. 5, having an outermost ring having an MD dimension of MDC2 and a CD dimension of CDC2.

Further concentric rings can be utilized. The discrete raised portions 14 can be in a "bi-" or "tri-concentric" pattern, with the prefix denoting the number of "rings" of a particular size of discrete raised portions 14 surrounding a central group, or single discrete raised portion. In general, the size of discrete raised portions 14 can get smaller as the rings go outward from the center, in a C-B-A arrangement. However, it is contemplated that the reverse, i.e., an A-B-C arrangement can be achieved. Also, mixed arrangements can be achieved, such as a BAABBCC arrangement (Center discrete raised portion 14 is a B-size, with the bi-concentric arrangement of A,A,B,B,C,C surrounding the central B-size portion.

In general, in the patterns of the present invention there can be 1 to 4 consecutive concentric rings of the A-size discrete raised portions 14, 1 to 3 consecutive concentric rings of the B-size discrete raised portions 14, and 1 to 2 consecutive concentric rings of the C-size discrete raised portions 14.

In general, in patterns of the present invention there can be from about 30% to about 50% by area A-size discrete raised portions 14, from about 30% to about 60% by area B-size discrete raised portions 14, from about 5% to about 30% by area C-size discrete raised portions 14. In general, the area relationships translate to the relatively high density discrete elements of the fibrous structure formed by the papermaking belt.

In general, the dimensions indicated in FIG. 5 for the discrete raised portions 14 can have the ranges shown in Table 1 below. For example, the dimension denoted MD-A in FIG. 5 is read in Table 1 as being the dimension in inches in the MD column and in the row for the type "A" discrete raised portion. The ranges listed in the columns of Table 1 as MDmax (inches) and CDmax (inches) can be equal to the ranges of MDmax and CDmax, respectively, as described above with reference to FIG. 3.

TABLE 1

| Discrete Raised portion 14Type | CDmax (inches) | MDmax (inches) |
|---|---|---|
| A | 0.0660-0.0686 | 0.0428-0.0454 |
| B | 0.0686-0.0776 | 0.0454-0.0492 |
| C | 0.0776-0.0880 | 0.0492-0.0540 |

In general, the dimensions indicated in FIG. 5 for the substantially continuous deflection conduit 16 can have the ranges shown in Table 2 below.

TABLE 2

| Deflection conduit notation | Width (inches) |
|---|---|
| CD A-A | 0.0621-0.0640 |
| CD A-B | 0.0608-0.0621 |
| CD B-C | 0.0550-0.0608 |
| MD A-B | 0.0840-0.0870 |
| MD: B-C | 0.0807-0.0840 |
| DIAG A-A | 0.0495-0.0500 |
| DIAG A-B | 0.0482-0.0495 |
| DIAG B-B | 0.0469-0.0482 |
| DIAG B-C | 0.0453-0.0469 |

Papermaking

Figure 6:
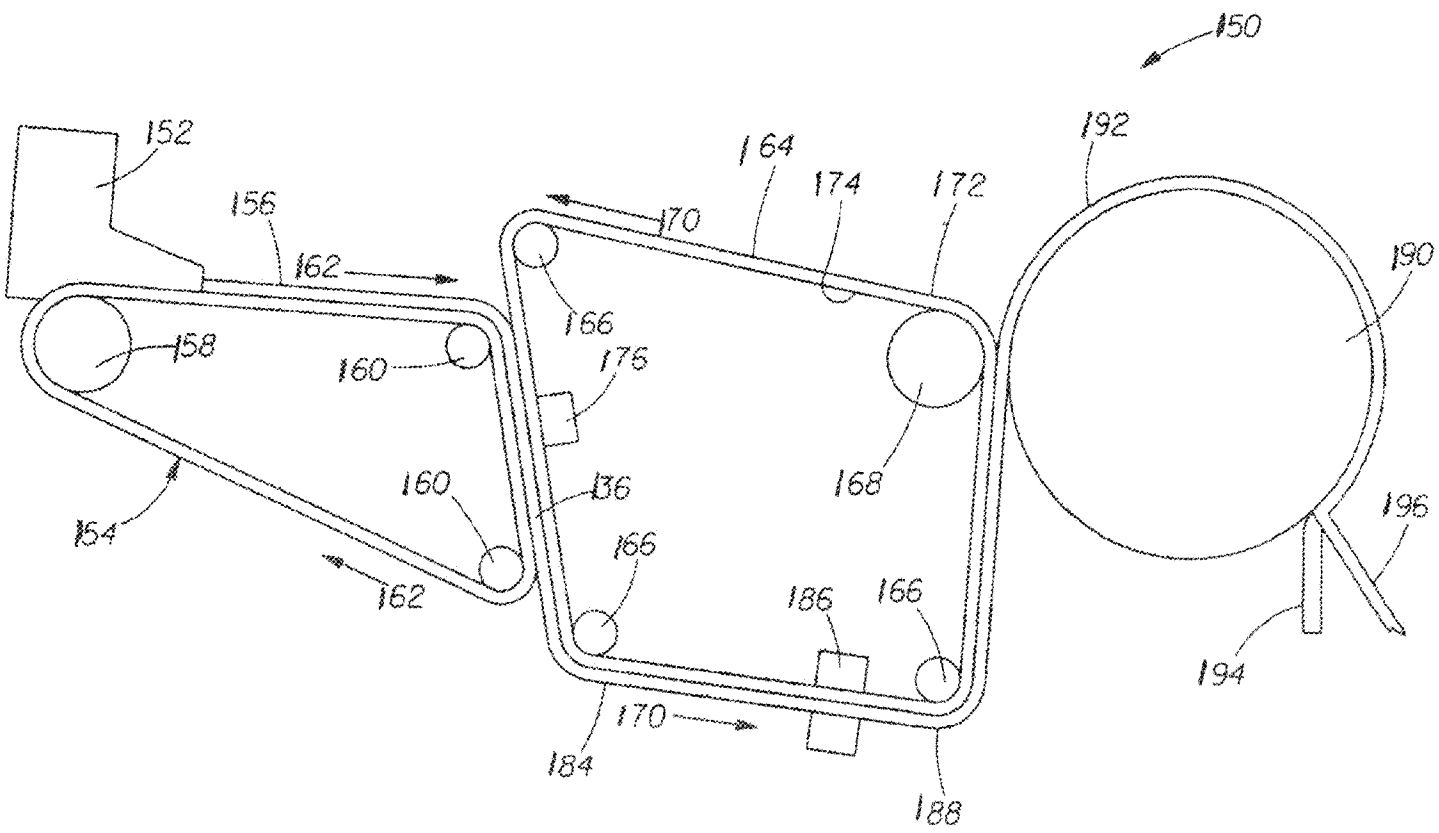
FIG. 6 is a schematic representation of a papermaking apparatus for using a papermaking belt of the present invention and for making a fibrous structure of the present invention.

The fibrous structure of the present invention having improved properties can be made on papermaking belts as described above. Two nonlimiting examples are described herein. Both examples utilized a process as disclosed herein with reference to FIG. 6. FIG. 6 and the description below is one method for making a fibrous structure of the present invention utilizing a papermaking belt, or "molding member," as described above. However, one skilled in the art will recognize that modifications to other parts of the process described below, for example, utilization of different type of head box, different drying, or the like, can be made to successfully make a fibrous structure of the present invention.

In general, a method for making the fibrous structures of the present disclosure, the method can comprise the step of contacting an embryonic fibrous web with a molding member such that at least one portion of the embryonic fibrous web is deflected out-of-plane with respect to another portion of the embryonic fibrous web. The phrase "out-of-plane" as used herein means that the fibrous structure comprises a protuberance, such as a dome, or a cavity that extends away from the plane of the fibrous structure. The molding member can comprise a through-air-drying fabric having its filaments arranged to produce discrete elements within the fibrous structures of the present disclosure and/or the through-air-drying fabric or equivalent can comprise a resinous framework that defines continuous or substantially continuous deflection conduits or discrete deflection cells that allow portions of the fibrous structure to deflect into the conduits thus forming discrete elements (either relatively high or relatively low density depending on the molding member) within the fibrous structures of the present disclosure. In addition, a forming wire, such as a foraminous member can be used to receive a fibrous furnish and create an embryonic fibrous web thereon.

Further by way of example of a method for making fibrous structures of the present disclosure, the method can comprise the steps of:

(a) providing a fibrous furnish comprising fibers; and (b) depositing the fibrous furnish onto a molding member such that at least one fiber is deflected out-of-plane of the other fibers present on the molding member.

In still another example of a method for making a fibrous structure of the present disclosure, the method comprises the steps of:

(a) providing a fibrous furnish comprising fibers;

(b) depositing the fibrous furnish onto a foraminous member to form an embryonic fibrous web;

(c) associating the embryonic fibrous web with a molding member such that at least one fiber is deflected out-of-plane of the other fibers present in the embryonic fibrous web; and (d) drying said embryonic fibrous web such that that the dried fibrous structure is formed.

In another example of a method for making the fibrous structures of the present disclosure, the method can comprise the steps of:

(a) providing a fibrous furnish comprising fibers;

(b) depositing the fibrous furnish onto a foraminous member such that an embryonic fibrous web is formed;

(c) associating the embryonic web with a molding member comprising discrete deflection cells or substantially continuous deflection conduits;

(d) deflecting the fibers in the embryonic fibrous web into the discrete deflection cells or substantially continuous deflection conduit 16*s* and removing water from the embryonic web through the discrete deflection cells or substantially continuous deflection conduit 16*s* so as to form an intermediate fibrous web under such conditions that the deflection of fibers is initiated no later than the time at which the water removal through the discrete deflection cells or the substantially continuous deflection conduits is initiated; and (e) optionally, drying the intermediate fibrous web; and (f) optionally, foreshortening the intermediate fibrous web.

FIG. 6 is a simplified, schematic representation of one example of a continuous fibrous structure making process and machine useful in the practice of the present disclosure.

As shown in FIG. 6, one example of a process and equipment, represented as 150, for making fibrous structures according to the present disclosure comprises supplying an aqueous dispersion of fibers (a fibrous furnish) to a headbox 152 which can be of any design known to those of skill in the art. From the headbox 152, the aqueous dispersion of fibers can be delivered to a foraminous member 154, which can be a Fourdrinier wire, to produce an embryonic fibrous web 156.

The foraminous member 154 can be supported by a breast roll 158 and a plurality of return rolls 160 of which only two are illustrated. The foraminous member 154 can be propelled in the direction indicated by directional arrow 162 by a drive means, not illustrated. Optional auxiliary units and/or devices commonly associated with fibrous structure making machines and with the foraminous member 154, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 154, the embryonic fibrous web 156 is formed, typically by the removal of a portion of the aqueous dispersing medium by techniques known to those skilled in the art. Vacuum boxes, forming boards, hydrofoils, and other various equipment known to those of skill in the art are useful in effectuating water removal. The embryonic fibrous web 156 can travel with the foraminous member 154 about return roll 160 and can be brought into contact with a molding member 164, also referred to as a papermaking belt. While in contact with the molding member 164, the embryonic fibrous web 156 can be deflected, rearranged, and/or further dewatered.

The molding member 164 can be in the form of an endless belt. In this simplified representation, the molding member 164 passes around and about molding member return rolls 166 and impression nip roll 168 and can travel in the direction indicated by directional arrow 170. Associated with the molding member 164, but not illustrated, can be various support rolls, other return rolls, cleaning means, drive means, and other various equipment known to those of skill in the art that may be commonly used in fibrous structure making machines.

Regardless of the physical form which the molding member 164 takes, whether it is an endless belt as just discussed or some other embodiment, such as a stationary plate for use in making handsheets or a rotating drum for use with other types of continuous processes, it should have certain physical characteristics. For example, the molding member 164 can take a variety of configurations such as belts, drums, flat plates, and the like.

First, the molding member 164 can be foraminous. That is to say, it may possess continuous passages connecting its first surface 172 (or "upper surface" or "working surface"; i.e., the surface with which the embryonic fibrous web 156 is associated) with its second surface 174 (or "lower surface; i.e., the surface with which the molding member return rolls 166 are associated). In other words, the molding member 164 can be constructed in such a manner that when water is caused to be removed from the embryonic fibrous web 156, as by the application of differential fluid pressure, such as by a vacuum box 176, and when the water is removed from the embryonic fibrous web 156 in the direction of the molding member 164, the water can be discharged from the system without having to again contact the embryonic fibrous web 156 in either the liquid or the vapor state.

Second, the first surface 172 of the molding member 164 can comprise one or more discrete raised portions 14 or one or more continuous or substantially continuous members. The discrete raised portions 14 or the continuous substantially continuous members can be made using any suitable material. For example, a resin, such as a photocurable resin, for example, can be used to create the discrete raised portions 14 or the continuous or substantially continuous member. The discrete raised portions 14 or the continuous or substantially continuous member can be arranged to produce the fibrous structures of the present disclosure when utilized in a suitable fibrous structure making process.

In one example, the molding member 164 can be an endless belt which can be constructed by, among other methods, a method adapted from techniques used to make stencil screens. By "adapted" it is meant that the broad, overall techniques of making stencil screens are used, but improvements, refinements, and modifications as discussed below are used to make the molding member 164 having significantly greater thickness than the usual stencil screen.

Broadly, a reinforcing element 202 or (such as a woven belt) is thoroughly coated with a liquid photosensitive polymeric resin to a preselected thickness. A film or negative incorporating the pattern (e.g., FIG. 3) is juxtaposed on the liquid photosensitive resin. The resin is then exposed to light of an appropriate wave length through the film. This exposure to light causes curing of the resin in the exposed areas (i.e., white portions or non-printed portions in the film). Uncured resin (under the black portions or printed portions in the film) is removed from the system leaving behind the cured resin forming the pattern illustrated herein.

Suitable photosensitive resins can be readily selected from the many available commercially. They are typically materials, usually polymers, which cure or cross-link under the influence of activating radiation, usually ultraviolet (UV) light. References containing more information about liquid photosensitive resins include Green et al., "Photocross-linkable Resin Systems," J. Macro. Sci-Revs. Macro. Chem., C21(2), 187-273 (1981-82); Boyer, "A Review of Ultraviolet Curing Technology," Tappi Paper Synthetics Conf. Proc., Sep. 25-27, 1978, pp 167-172; and Schmidle, "Ultraviolet Curable Flexible Coatings," J. of Coated Fabrics, 8, 10-20 (July, 1978). In one example, the discrete raised portions 14 206 or the continuous or substantially continuous members 206' are made from the Merigraph series of resins made by Hercules Incorporated of Wilmington, Del.

The molding members of the present disclosure can be made, or partially made, according to the process described in U.S. Pat. No. 4,637,859, issued Jan. 20, 1987, to Trokhan.

After the embryonic fibrous web 156 has been associated with the molding members 164, fibers within the embryonic fibrous web 156 are deflected into the continuous or substantially continuous deflection conduits 16 present in the molding members 164. In one example of this process step, there is essentially no water removal from the embryonic fibrous web 156 through the continuous or substantially continuous deflection conduits 16 after the embryonic fibrous web 156 has been associated with the molding members 164 but prior to the deflecting of the fibers into the continuous or substantially continuous deflection conduits 16. Further water removal from the embryonic fibrous web 156 can occur during and/or after the time the fibers are being deflected into the continuous or substantially continuous deflection conduits 16. Water removal from the embryonic fibrous web 156 can continue until the consistency of the embryonic fibrous web 156 associated with the molding member 164 is increased to from about 25% to about 35%. Once this consistency of the embryonic fibrous web 156 is achieved, then the embryonic fibrous web 156 is referred to as an intermediate fibrous web 184. During the process of forming the embryonic fibrous web 156, sufficient water can be removed, such as by a noncompressive process, from the embryonic fibrous web 156 before it becomes associated with the molding member 164 so that the consistency of the embryonic fibrous web 156 can be from about 10% to about 30%.

As noted, water removal occurs both during and after deflection; this water removal can result in a decrease in fiber mobility in the embryonic fibrous web. This decrease in fiber mobility may tend to fix and/or freeze the fibers in place after they have been deflected and rearranged. Of course, the drying of the web in a later step in the process of this disclosure serves to more firmly fix and/or freeze the fibers in position.

Any convenient methods conventionally known in the papermaking art can be used to dry the intermediate fibrous web 184. Examples of such suitable drying process include subjecting the intermediate fibrous web 184 to conventional and/or flow-through dryers and/or Yankee dryers.

In one example of a drying process, the intermediate fibrous web 184 in association with the molding member 164 passes around the molding member return roll 166 and travels in the direction indicated by directional arrow 170. The intermediate fibrous web 184 can first pass through an optional predryer 186. This predryer 186 can be a conventional flow-through dryer (hot air dryer) known to those skilled in the art. Optionally, the predryer 186 can be a so-called capillary dewatering apparatus. In such an apparatus, the intermediate fibrous web 184 passes over a sector of a cylinder having preferential-capillary-size pores through its cylindrical-shaped porous cover. Optionally, the predryer 186 can be a combination capillary dewatering apparatus and flow-through dryer. The quantity of water removed in the predryer 186 can be controlled so that a predried fibrous web 188 exiting the predryer 186 has a consistency of from about 30% to about 98%. The predried fibrous web 188, which can still be associated with papermaking belt 200, can pass around another papermaking belt return roll 166 and as it travels to an impression nip roll 168. As the predried fibrous web 188 passes through the nip formed between impression nip roll 168 and a surface of a Yankee dryer 190, the pattern formed by the top surface 172 of the molding member 164 is impressed into the predried fibrous web 188 to form discrete elements (relatively high density) or, alternatively, a substantially continuous network (relatively high density) imprinted in the fibrous web 192. The imprinted fibrous web 192 can then be adhered to the surface of the Yankee dryer 190 where it can be dried to a consistency of at least about 95%.

The imprinted fibrous web 192 can then be foreshortened by creping the web 192 with a creping blade 194 to remove the web 192 from the surface of the Yankee dryer 190 resulting in the production of a creped fibrous structure 196 in accordance with the present disclosure. As used herein, foreshortening refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Foreshortening can be accomplished in any of several ways. One common method of foreshortening is creping. The creped fibrous structure 196 can be subjected to post processing steps such as calendaring, tuft generating operations, embossing, and/or converting.

In addition to the Yankee fibrous structure making process/method, the fibrous structures of the present disclosure can be made using a Yankeeless fibrous structure making process/method. Such a process oftentimes utilizes transfer fabrics to permit rush transfer of the embryonic fibrous web prior to drying. The fibrous structures produced by such a Yankeeless fibrous structure making process oftentimes a substantially uniform density.

The molding member/papermaking belts of the present disclosure can be utilized to imprint discrete elements and a substantially continuous network into a fibrous structure during a through-air-drying operation.

However, such molding members/papermaking belts can also be utilized as forming members or foraminous members upon which a fiber slurry is deposited.

As discussed above, the fibrous structure can be embossed during a converting operating to produce the fibrous structures of the present disclosure. For example, the discrete elements and/or the continuous or substantially continuous network can be imparted to a fibrous structure by embossing.

Without being limited by theory, the present invention provides a fibrous structure that exhibits functional equilibrium as described herein, which unexpectedly may provide a product with enhanced durable-like performance throughout the cleaning process. The present invention is equally applicable to all types of consumer paper products such as paper towels, toilet tissue, facial tissue, napkins, and the like.

The present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, other natural fibers such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded.

In one embodiment the paper can be produced by forming a predominantly aqueous slurry comprising about 95% to about 99.9% water. In one embodiment the non-aqueous component of the slurry used to make the fibrous structure can comprise from about 5% to about 80% of eucalpyptus fibers by weight of the non-aqueous components of the slurry. In another embodiment the non-aqueous components can comprise from about 8% to about 60% of eucalpyptus fibers by weight of the non aqueous components of the slurry, and in yet another embodiment from about 15% to about 30% of eucalyptus fibers by weight of the non-aqueous component of the slurry. In one embodiment the slurry can comprise of about 45% to about 60% of Northern Softwood Kraft fibers with up to 20% Southern Softwood Kraft co-refined together, about 25% to about 35% unrefined Eucalyptus fibers and from about 5% to about 30% of either repulped product broke or thermo-mechanical pulp. The aqueous slurry can be pumped to the headbox of the papermaking process.

In one embodiment the present invention may comprise a co-formed fibrous structure. A co-formed fibrous structure comprises a mixture of at least two different materials wherein at least one of the materials comprises a non-naturally occurring fiber, such as a polypropylene fiber, and at least one other material, different from the first material, comprising a solid additive, such as another fiber and/or a particulate. In one example, a co-formed fibrous structure comprises solid additives, such as naturally occurring fibers, such as wood pulp fibers, and non-naturally occurring fibers, such as polypropylene fibers.

Synthetic fibers useful herein include any material, such as, but not limited to polymers, those selected from the group consisting of polyesters, polypropylenes, polyethylenes, polyethers, polyamides, polyhydroxyalkanoates, polysaccharides, and combinations thereof. More specifically, the material of the polymer segment may be selected from the group consisting of poly(ethylene terephthalate), poly (butylene terephthalate), poly(1,4-cyclohexylenedimethylene terephthalate), isophthalic acid copolymers (e.g., terephthalate cyclohexylene-dimethylene isophthalate copolymer), ethylene glycol copolymers (e.g., ethylene terephthalate cyclohexylene-dimethylene copolymer), polycaprolactone, poly(hydroxyl ether ester), poly(hydroxyl ether amide), polyesteramide, poly(lactic acid), polyhydroxybutyrate, and combinations thereof.

Further, the synthetic fibers can be a single component (i.e., single synthetic material or a mixture to make up the entire fiber), bi-component (i.e., the fiber is divided into regions, the regions including two or more different synthetic materials or mixtures thereof and may include co-extruded fibers) and combinations thereof. It is also possible to use bicomponent fibers, or simply bicomponent or sheath polymers. Nonlimiting examples of suitable bicomponent fibers are fibers made of copolymers of polyester (polyethylene terephthalate)/polyester (polyethylene terephthalate) otherwise known as "CoPET/PET" fibers, which are commercially available from Fiber Innovation Technology, Inc., Johnson City, Tenn.

These bicomponent fibers can be used as a component fiber of the structure, and/or they may be present to act as a binder for the other fibers present. Any or all of the synthetic fibers may be treated before, during, or after the process of the present invention to change any desired properties of the fibers. For example, in certain embodiments, it may be desirable to treat the synthetic fibers before or during the papermaking process to make them more hydrophilic, more wettable, etc.

These multicomponent and/or synthetic fibers are further described in U.S. Pat. No. 6,746,766, issued on Jun. 8, 2004; U.S. Pat. No. 6,946,506, issued Sep. 20, 2005; U.S. Pat. No. 6,890,872, issued May 10, 2005; US Publication No. 2003/0077444A1, published on Apr. 24, 2003; US Publication No. 2003/0168912A1, published on Nov. 14, 2002; US Publication No. 2003/0092343A1, published on May 15, 2003; US Publication No. 2002/0168518A1, published on Nov. 14, 2002; US Publication No. 2005/0079785A1, published on Apr. 14, 2005; US Publication No. 2005/0026529A1, published on Feb. 3, 2005; US Publication No. 2004/0154768A1, published on Aug. 12, 2004; US Publication No. 2004/0154767, published on Aug. 12, 2004; US Publication No. 2004/0154769A1, published on Aug. 12, 2004; US Publication No. 2004/0157524A1, published on Aug. 12, 2004; US Publication No. 2005/0201965A1, published on Sep. 15, 2005.

The fibrous structure may comprise any processes and apparatus known for the manufacture of tissue-towel paper product. Embodiments of these processes and apparatus may be made according to the teachings of U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995, and U.S. Patent Application 2004/0192136A1 published in the name of Gusky et al. on Sep. 30, 2004.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Uncreped tissue paper, in one embodiment, refers to tissue paper which is non-compressively dried, by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 published Aug. 12, 1997.

Other materials are also intended to be within the scope of the present invention as long as they do not interfere or counteract any advantage presented by the instant invention.

The fibrous structure product according to the present invention can have domes, as taught by commonly assigned U.S. Pat. No. 4,528,239 issued Jul. 9, 1985 to Trokhan; U.S. Pat. No. 4,529,480 issued Jul. 16, 1985 to Trokhan; U.S. Pat. No. 5,275,700 issued Jan. 4, 1994 to Trokhan; U.S. Pat. No. 5,364,504 issued Nov. 15, 1985 to Smurkoski et al.; U.S. Pat. No. 5,527,428 issued Jun. 18, 1996 to Trokhan et al.; U.S. Pat. No. 5,609,725 issued Mar. 11, 1997 to Van Phan; U.S. Pat. No. 5,679,222 issued Oct. 21, 1997 to Rasch et al.; U.S. Pat. No. 5,709,775 issued Jan. 20, 1995 to Trokhan et al.; U.S. Pat. No. 5,795,440 issued Aug. 18, 1998 to Ampulski et al.; U.S. Pat. No. 5,900,122 issued May 4, 1999 to Huston; U.S. Pat. No. 5,906,710 issued May 25, 1999 to Trokhan; U.S. Pat. No. 5,935,381 issued Aug. 10, 1999 to Trokhan et al.; and U.S. Pat. No. 5,938,893 issued Aug. 17, 1999 to Trokhan et al.

In one embodiment the plies of the multi-ply fibrous structure may be the same substrate respectively or the plies may comprise different substrates combined to create desired consumer benefits. In one embodiment the fibrous structures comprise two plies of tissue substrate. In another embodiment the fibrous structure comprises a first ply, a second ply, and at least one inner ply.

In one embodiment of the present invention, the fibrous structure product has a plurality of embossments. In one embodiment the embossment pattern is applied only to the first ply, and therefore, each of the two plies serve different objectives and are visually distinguishable. For instance, the embossment pattern on the first ply provides, among other things, improved aesthetics regarding thickness and quilted appearance, while the second ply, being unembossed, is devised to enhance functional qualities such as absorbency, thickness and strength. In another embodiment the fibrous structure product is a two ply product wherein both plies comprise a plurality of embossments.

Suitable means of embossing include those disclosed in U.S. Pat. No. 3,323,983 issued to Palmer on Sep. 8, 1964; U.S. Pat. No. 5,468,323 issued to McNeil on Nov. 21, 1995; U.S. Pat. No. 5,693,406 issued to Wegele et al. on Dec. 2, 1997; U.S. Pat. No. 5,972,466 issued to Trokhan on Oct. 26, 1999; U.S. Pat. No. 6,030,690 issued to McNeil et al. on Feb. 29, 2000; and U.S. Pat. No. 6,086,715 issued to McNeil on July 11.

Suitable means of laminating the plies include but are not limited to those methods disclosed in commonly assigned U.S. Pat. No. 6,113,723 issued to McNeil et al. on Sep. 5, 2000; U.S. Pat. No. 6,086,715 issued to McNeil on Jul. 11, 2000; U.S. Pat. No. 5,972,466 issued to Trokhan on Oct. 26, 1999; U.S. Pat. No. 5,858,554 issued to Neal et al. on Jan. 12, 1999; U.S. Pat. No. 5,693,406 issued to Wegele et al. on Dec. 2, 1997; U.S. Pat. No. 5,468,323 issued to McNeil on Nov. 21, 1995; U.S. Pat. No. 5,294,475 issued to McNeil on Mar. 15, 1994.

The fibrous structure product may be in roll form. When in roll form, the fibrous structure product may be wound about a core or may be wound without a core.

Optional Ingredients

The multi-ply fibrous structure product herein may optionally comprise one or more ingredients that may be added to the aqueous papermaking furnish or the embryonic web. These optional ingredients may be added to impart other desirable characteristics to the product or improve the papermaking process so long as they are compatible with the other components of the fibrous structure product and do not significantly and adversely effect the functional qualities of the present invention. The listing of optional chemical ingredients is intended to be merely exemplary in nature, and are not meant to limit the scope of the invention. Other materials may be included as well so long as they do not interfere or counteract the advantages of the present invention.

A cationic charge biasing species may be added to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. In one embodiment the cationic charge biasing species is alum. In addition charge biasing may be accomplished by use of relatively low molecular weight cationic synthetic polymer, in one embodiment having a molecular weight of no more than about 500,000 and in another embodiment no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn.

High surface area, high anionic charge microparticles for the purposes of improving formation, drainage, strength, and retention may also be included herein. See, for example, U.S. Pat. No. 5,221,435, issued to Smith on Jun. 22, 1993.

If permanent wet strength is desired, cationic wet strength resins may be optionally added to the papermaking furnish or to the embryonic web. From about 2 to about 50 lbs./ton of dry paper fibers of the cationic wet strength resin may be used, in another embodiment from about 5 to about 30 lbs./ton, and in another embodiment from about 10 to about 25 lbs./ton.

The cationic wet strength resins useful in this invention include without limitation cationic water soluble resins. These resins impart wet strength to paper sheets and are well known to the paper making art. This resin may impart either temporary or permanent wet strength to the sheet. Such resins include the following Hercules products. KYMENE® resins obtainable from Hercules Inc., Wilmington, Del. may be used, including KYMENE® 736 which is a polyethyleneimine (PEI) wet strength polymer. It is believed that the PEI imparts wet strength by ionic bonding with the pulps carboxyl sites. KYMENE® 557LX is polyamide epichlorohydrin (PAE) wet strength polymer. It is believed that the PAE contains cationic sites that lead to resin retention by forming an ionic bond with the carboxyl sites on the pulp. The polymer contains 3-azetidinium groups which react to form covalent bonds with the pulps' carboxyl sites as well as with the polymer backbone. The product must undergo curing in the form of heat or undergo natural aging for the reaction of the azentidinium group. KYMENE® 450 is a base activated epoxide polyamide epichlorohydrin polymer. It is theorized that like 557LX the resin attaches itself ionically to the pulps' carboxyl sites. The epoxide group is much more reactive than the azentidinium group. The epoxide group reacts with both the hydroxyl and carboxyl sites on the pulp, thereby giving higher wet strengths. The epoxide group can also crosslink to the polymer backbone. KYMENE® 2064 is also a base activated epoxide polyamide epichlorohydrin polymer. It is theorized that KYMENE® 2064 imparts its wet strength by the same mechanism as KYMENE® 450. KYMENE® 2064 differs in that the polymer backbond contains more epoxide functional groups than does KYMENE® 450. Both KYMENE® 450 and KYMENE® 2064 require curing in the form of heat or natural aging to fully react all the epoxide groups, however, due to the reactiveness of the epoxide group, the majority of the groups (80-90%) react and impart wet strength off the paper machine. Mixtures of the foregoing may be used. Other suitable types of such resins include urea-formaldehyde resins, melamine formaldehyde resins, polyamide-epichlorohydrin resins, polyethyleneimine resins, polyacrylamide resins, dialdehyde starches, and mixtures thereof. Other suitable types of such resins are described in U.S. Pat. No. 3,700,623, issued Oct. 24, 1972; U.S. Pat. No. 3,772,076, issued Nov. 13, 1973; U.S. Pat. No. 4,557,801, issued Dec. 10, 1985 and U.S. Pat. No. 4,391,878, issued Jul. 5, 1983.

In one embodiment, the cationic wet strength resin may be added at any point in the processes, where it will come in contact with the paper fibers prior to forming the wet web.

If enhanced absorbency is needed, surfactants may be used to treat the paper webs of the present invention. The level of surfactant, if used, in one embodiment, from about 0.01% to about 2.0% by weight, based on the dry fiber weight of the tissue web. In one embodiment the surfactants have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

In addition, chemical softening agents may be used. In one embodiment the chemical softening agents comprise quaternary ammonium compounds including, but not limited to, the well-known dialkyldimethylammonium salts (e.g., ditallowedimethylammonium chloride, ditallowedimethylammonium methyl sulfate ("DTDMAMS"), di(hydrogenated tallow)dimethyl ammonium chloride, etc.). In another embodiment variants of these softening agents include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate.

Another class of papermaking-added chemical softening agents comprises organo-reactive polydimethyl siloxane ingredients, including the amino functional polydimethyl siloxane. The fibrous structure product of the present invention may further comprise a diorganopolysiloxane-based polymer. These diorganopolysiloxane-based polymers useful in the present invention span a large range of viscosities; from about 10 to about 10,000,000 centistokes (cSt) at 25° C. Some diorganopolysiloxane-based polymers useful in this invention exhibit viscosities greater than 10,000,000 centistokes (cSt) at 25° C. and therefore are characterized by manufacturer specific penetration testing. Examples of this characterization are GE silicone materials SE 30 and SE 63 with penetration specifications of 500-1500 and 250-600 (tenths of a millimeter) respectively.

Among the diorganopolysiloxane polymers of the present invention are diorganopolysiloxane polymers comprising repeating units, where said units correspond to the formula $(R_2SiO)_n$, where R is a monovalent radical containing from 1 to 6 carbon atoms, in one embodiment selected from the group consisting of methyl, ethyl, propyl, isopropyl, butyl, isobutyl, t-butyl, amyl, hexyl, vinyl, allyl, cyclohexyl, amino alkyl, phenyl, fluoroalkyl and mixtures thereof. The diorganopoylsiloxane polymers which may be employed in the present invention may contain one or more of these radicals as substituents on the siloxane polymer backbone. The diorganopolysiloxane polymers may be terminated by triorganosilyl groups of the formula $(R'_3Si)$ where R' is a monovalent radical selected from the group consisting of radicals containing from 1-6 carbon atoms, hydroxyl groups, alkoxyl groups, and mixtures thereof. In one embodiment the silicone polymer is a higher viscosity polymers, e.g., poly(dimethylsiloxane), herein referred to as PDMS or silicone gum, having a viscosity of at least 100,000 cSt.

Silicone gums, optionally useful herein, corresponds to the formula:

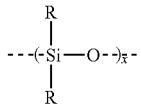

where R is a methyl group.

Fluid diorganopolysiloxane polymers that are commercially available, include SE 30 silicone gum and SF96 silicone fluid available from the General Electric Company. Similar materials can also be obtained from Dow Corning and from Wacker Silicones.

An additional fluid diorganosiloxane-based polymer optionally for use in the present invention is a dimethicone copolyol. The dimethicone copolyol can be further characterized as polyalkylene oxide modified polydimethysiloxanes, such as manufactured by the Witco Corporation under the trade name Silwet. Similar materials can be obtained from Dow Corning, Wacker Silicones and Goldschmidt Chemical Corporation as well as other silicone manufacturers. Silicones useful herein are further disclosed in U.S. Pat. Nos. 5,059,282; 5,164,046; 5,246,545; 5,246,546; 5,552,345; 6,238,682; 5,716,692.

In addition antibacterial agents, coloring agents such as print elements, perfumes, dyes, and mixtures thereof, may be included in the fibrous structure product of the present invention.

Nonlimiting Examples 1 and 2

Two examples of fibrous structures made according to the present invention on papermaking belts (molding members) of the present invention are disclosed.

In Examples 1 and 2 the non-aqueous component of the slurry used to make the fibrous structure comprised about 35% of Eucalyptus fibers by weight of the non-aqueous components of the slurry and about 40% to 50% of Northern Softwood Kraft fibers 0% to 10% Southern Softwood Kraft co-refined by 4.5 and 5.5 NHPD/T respectively. Examples 1 and 2 slurries also comprise 15% of re-pulped product broke pulp. The single ply basis weight for the fibrous structures of Examples 1 and 2 were 15 lbs/3000 $ft^2$ and 16 lbs/3000 $ft^2$ respectively.

Cationic permanent wet strength resin of 21 lbs per ton was added to the papermaking furnish. The wet strength resin was KYMENE® obtainable from Hercules Inc., Wilmington, Del. An anionic charge dry strength agent Carboxymethyl Cellulose was added for the purposes of improving formation, drainage, strength, and retention.

The aqueous slurry was pumped to the headbox of the papermaking process. Examples 1 and 2 were produced by forming a predominantly aqueous slurry comprising about 95% to about 99.9% water via a wet-laid making process where the resulting web is through-air-dried. The substrates of Examples 1 and 2 were then foreshortened by wet microcontraction of negative 15% and 18% rush respectively, as is known in the art, and disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

The fibrous structure is through air dried on a belt having a patterned framework as disclosed herein, specifically with dimensions reference to Tables 3-8 below. In Examples 1 and 2 the substrates were pattern densified tissue paper which is characterized by discrete relatively high density zones, alternatively referred to as knuckle regions.

Examples 1 and 2 substrates were each then dried on a Yankee dryer and creped off the Yankee under the following creping geometry: 100 degree impact angle and 45 degree doctor blade, and were then wound onto a parent roll reel.

Example 1 and 2 were each laminated into a multiply structure having a basis weight of 31 and 32 lbs/3000 $ft^2$, respectively, with a plurality of embossments having a "wavy diamond" pattern of discrete emboss points, as shown in FIG. 1. Embossing can be by any suitable method, including methods disclosed in U.S. Pat. No. 3,323,983 issued to Palmer on Sep. 8, 1964; U.S. Pat. No. 5,468,323 issued to McNeil on Nov. 21, 1995; U.S. Pat. No. 5,693,406 issued to Wegele et al. on Dec. 2, 1997; U.S. Pat. No. 5,972,466 issued to Trokhan on Oct. 26, 1999; U.S. Pat. No. 6,030,690 issued to McNeil et al. on Feb. 29, 2000; and U.S. Pat. No. 6,086,715 issued to McNeil on July 11.

Laminating the plies can be by any suitable means, including by the methods disclosed in commonly assigned U.S. Pat. No. 6,113,723 issued to McNeil et al. on Sep. 5, 2000; U.S. Pat. No. 6,086,715 issued to McNeil on Jul. 11, 2000; U.S. Pat. No. 5,972,466 issued to Trokhan on Oct. 26, 1999; U.S. Pat. No. 5,858,554 issued to Neal et al. on Jan. 12, 1999; U.S. Pat. No. 5,693,406 issued to Wegele et al. on Dec. 2, 1997; U.S. Pat. No. 5,468,323 issued to McNeil on Nov. 21, 1995; U.S. Pat. No. 5,294,475 issued to McNeil on Mar. 15, 1994.

The fibrous structure product in Example 1 and 2 were formed into roll form. When in roll form, the fibrous structure products were wound about a core.

For Nonlimiting Example 1, the molding member, i.e., the papermaking belt had the properties and dimensions as indicated in Tables 3-5 below.

TABLE 3

Dimensions of discrete raised portions 14, embodiment Example 1

| Discrete Raised portion 14Type | CDmax dimensions (inches) | MDmax dimension (inches) |
|---|---|---|
| A | 0.0660 | 0.0428 |
| B | 0.0686 | 0.0454 |
| C | 0.0776 | 0.0492 |

TABLE 4

Dimensions of deflection conduit, embodiment Example 1

| Deflection conduit notation | Width (inches) |
|---|---|
| CD (A-A) | 0.0621 |
| CD (A-B) | 0.0608 |
| CD (B-C) | 0.0550 |
| MD (A-B) | 0.0840 |
| MD(B-C) | 0.0807 |
| DIAG (A-A) | 0.0495 |
| DIAG (A-B) | 0.0482 |
| DIAG (B-B) | 0.0469 |
| DIAG (B-C) | 0.0453 |

TABLE 5

Dimensions of rhomboid-shaped concentric rings, Example 1

| | Length, inches |
|---|---|
| MDC1 | 0.2561 |
| MDC2 | 0.5121 |
| CDC1 | 0.2561 |
| CDC2 | 0.5121 |

For Nonlimiting Example 2, the molding member, i.e., the papermaking belt had the properties and dimensions as indicated in Tables 6-8 below.

TABLE 6

Dimensions of discrete raised portions 14, embodiment Example 2

| Discrete Raised portion 14Type | CDmax dimension (inches) | MDmax dimension (inches) |
|---|---|---|
| A | 0.0660 | 0.0428 |
| B | 0.0686 | 0.0454 |
| C | 0.0776 | 0.0492 |

TABLE 7

Dimensions of deflection conduit, embodiment Example 2

| Deflection conduit notation | Width (inches) |
|---|---|
| CD (A-A) | 0.0621 |
| CD (A-B) | 0.0608 |
| CD (B-C) | 0.0550 |
| MD (A-B) | 0.0840 |
| MD(B-C) | 0.0807 |
| DIAG (A-A) | 0.0495 |
| DIAG (A-B) | 0.0482 |
| DIAG (B-B) | 0.0469 |
| DIAG (B-C) | 0.0453 |

TABLE 8

| Dimensions of rhomboid-shaped concentric rings, Example 2 | |
|---|---|
| | Length, inches |
| MDC1 | 0.2561 |
| MDC2 | 0.5121 |
| MCD3 | 0.7681 |
| MCD4 | 1.0241 |
| MCD5 | 1.2801 |
| MCD6 | 1.5361 |
| MCD7 | 1.7925 |
| CDC1 | 0.2561 |
| CDC2 | 0.5121 |
| CDC3 | 0.7681 |
| CDC4 | 1.0241 |
| CDC5 | 1.2801 |
| CDC6 | 1.5361 |
| CDC7 | 1.7925 |

In general, the dimensions of the rings of a fibrous structure of the present invention can be calculated as:

$$MDC(n)=MDC(n-1)+2\times(MDC1)/2$$

$$CDC(n)=CDC(n-1)+2\times(CDC1)/2$$

Where $10 \leq n \leq 2$

A fibrous structure made on a papermaking belt having discrete raised portions 14 in patterns disclosed above exhibits significant benefits over prior fibrous structures. When formed into a into a sanitary tissue product, specifically, a paper towel, the fibrous structure exhibits improved X-Y plane force to gather compared to previous fibrous structures, as well as improved wet state Z-direction compression resistance. The orientations, X, Y, and Z refer to three dimensions, with the X-Y plane referring to the plane of a flat fibrous structure, and the Z-direction being perpendicular to the X-Y plane. The X-Y plane force to gather contributes to a user's impression of cloth-like structure, giving a paper towel a more resilient feel, for example, when the user gathers or "scrunches" a paper towel with his or her fingers on a flat surface.

Fibrous structures of the present invention also exhibit improved dry bulk, improved wet compression resistance, improved dry compression recovery, or resilience, and improved absorbency rate, all compared to prior fibrous structures. Improved, i.e., higher, wet compression resistance also contributes to an impression of cloth-like durability in a fibrous structure. Dry bulk properties and improved web wet and dry compression resistance are each measured by the measured, wet or dry, as required, by the 95 g Caliper Test, which, is shown below for wet caliper. The same test can be used for dry caliper merely by testing the dry structure (i.e., eliminating the step of wetting the structure).

All parameters are per test methods disclosed below.

Table 9 shows measured values for X-Y plane force to gather (referred to as In Plane Force to Gather, and measured as the Geometrical Mean (GM) of Flexural Bending by the GM-Flexural Bending Test Method) and Z-direction Compression Resistance (measured as Wet Caliper by the 95 g Wet Caliper Test) for multiple samples of both Example 1 and Example 2. In Table 9, each parameter measured is divided by the basis weight of the substrate to normalize the reported values.

TABLE 9

| Measures of In Plane Force to gather and Z-Compression Resistance | | |
|---|---|---|
| Technology | Z-direction Compression Resistance/Basis Weight (mils/lbs/3000 $ft^2$) | In Plane Force to Gather/Basis Weight (cm/lbs/3000 $ft^2$) |
| Example 2 | 1.09 | 0.34 |
| Example 2 | 1.11 | 0.33 |
| Example 2 | 1.07 | 0.33 |
| Example 2 | 0.96 | 0.33 |
| Example 1 | 1.00 | 0.38 |
| Example 1 | 0.99 | 0.37 |
| Example 1 | 0.97 | 0.34 |
| Example 1 | 1.11 | 0.35 |
| Example 1 | 1.09 | 0.34 |
| Example 1 | 1.04 | 0.35 |
| Example 1 | 1.01 | 0.34 |
| Example 1 | 0.98 | 0.36 |
| Example 1 | 0.98 | 0.34 |
| Example 1 | 0.96 | 0.34 |
| Example 1 | 0.97 | 0.35 |

Table 10 shows measured values for absorbency properties for multiple samples of both Example 1 and Example 2, measured according to the CRT test method disclosed herein.

TABLE 10

| Example No. | Absorbency Capacity g/sq in | Absorbency Rate SST_2-15 (g/sec 0.5) | Max Absorbent Capacity CRTmax (TIR.005) (g/s)*s |
|---|---|---|---|
| Example 2 | 0.708 | 1.96 | 6.32 |
| Example 2 | 0.684 | 2.01 | 6.19 |
| Example 2 | 0.650 | 1.89 | 6.07 |
| Example 2 | 0.660 | 1.60 | 6.26 |
| Example 1 | 0.623 | 1.73 | 5.87 |
| Example 1 | 0.643 | 1.67 | 5.96 |
| Example 1 | 0.667 | 1.59 | 6.10 |
| Example 1 | 0.644 | 1.80 | 5.79 |
| Example 1 | 0.702 | 1.63 | 6.32 |
| Example 1 | 0.630 | 1.55 | 5.94 |
| Example 1 | 0.637 | 1.59 | 6.00 |
| Example 1 | 0.643 | 1.60 | 5.89 |
| Example 1 | 0.621 | 1.54 | 5.75 |

While the inventors decline to be bound by any particular theory of operation, it appears that the mixed element design of the discrete raised portions of the molding member (papermaking belt) of the present invention with the specific distribution of pillow widths and knuckle sizes enable better wet web flow around the discrete raised portions to produce better fibrous structure properties.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All plastic and paper board packaging materials must be carefully removed from the paper samples prior to testing. Discard any damaged product. All tests are conducted in such conditioned room.

Basis Weight Test Method

Basis weight of a fibrous structure is measured on stacks of twelve usable units using a top loading analytical balance with a resolution of ±0.001 g. The balance is protected from air drafts and other disturbances using a draft shield. A precision cutting die, measuring 3.500 in ±0.0035 in by 3.500 in ±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example,

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

95 g Load Wet Caliper

The wet caliper of a sample of fibrous structure and/or sanitary tissue product comprising a fibrous structure is determined by cutting a sample of the fibrous structure and/or sanitary tissue product comprising a fibrous structure such that it is larger in size than a load foot loading surface where the load foot loading surface has a circular surface area of 3.14 $in^2$. Each sample is wetted by submerging the sample in a distilled water bath for 30 seconds. The caliper of the wet sample is measured within 30 seconds of removing the sample from the bath. The sample is then confined between a horizontal flat surface and the load foot loading surface. The load foot loading surface applies a confining pressure to the sample of 95 $g/in^2$. The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils (thousandths of an inch).

GM-Flexural Bending Test Method

This test is performed on 1 inch×6 inch (2.54 cm×15.24 cm) strips of a fibrous structure sample. A Cantilever Bending Tester such as described in ASTM Standard D 1388 (Model 5010, Instrument Marketing Services, Fairfield, N.J.) is used and operated at a ramp angle of 41.5±0.5° and a sample slide speed of 0.5±0.2 in/second (1.3±0.5 cm/second). A minimum of n=16 tests are performed on each sample from n=8 sample strips.

No fibrous structure sample which is creased, bent, folded, perforated, or in any other way weakened should ever be tested using this test. A non-creased, non-bent, non-folded, non-perforated, and non-weakened in any other way fibrous structure sample should be used for testing under this test.

From one fibrous structure sample of about 4 inch×6 inch (10.16 cm×15.24 cm), carefully cut using a 1 inch (2.54 cm) JDC Cutter (available from Thwing-Albert Instrument Company, Philadelphia, Pa.) four (4) 1 inch (2.54 cm) wide by 6 inch (15.24 cm) long strips of the fibrous structure in the MD direction. From a second fibrous structure sample from the same sample set, carefully cut four (4) 1 inch (2.54 cm) wide by 6 inch (15.24 cm) long strips of the fibrous structure in the CD direction. It is important that the cut be exactly perpendicular to the long dimension of the strip. In cutting non-laminated two-ply fibrous structure strips, the strips should be cut individually. The strip should also be free of wrinkles or excessive mechanical manipulation which can impact flexibility. Mark the direction very lightly on one end of the strip, keeping the same surface of the sample up for all strips. Later, the strips will be turned over for testing, thus it is important that one surface of the strip be clearly identified, however, it makes no difference which surface of the sample is designated as the upper surface.

Using other portions of the fibrous structure (not the cut strips), determine the basis weight of the fibrous structure sample in lbs/3000 $ft^2$ and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Place one of the strips on the horizontal platform using care to align the strip parallel with the movable sample slide. Align the strip exactly even with the vertical edge of the Tester wherein the angular ramp is attached or where the zero mark line is scribed on the Tester. Carefully place the sample slide bar back on top of the sample strip in the Tester. The sample slide bar must be carefully placed so that the strip is not wrinkled or moved from its initial position.

Move the strip and movable sample slide at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average overhang length is determined by averaging the sixteen (16) readings obtained on a fibrous structure.

$$\text{Overhang Length } MD = \frac{\text{Sum of 8 } MD \text{ readings}}{8}$$

$$\text{Overhang Length } CD = \frac{\text{Sum of 8 } CD \text{ readings}}{8}$$

$$\text{Overhang Length Total} = \frac{\text{Sum of all 16 readings}}{16}$$

$$\text{Bend Length } MD = \frac{\text{Overhang Length } MD}{2}$$

-continued $$\text{Bend Length } CD = \frac{\text{Overhang Length } CD}{2}$$

$$\text{Bend Length Total} = \frac{\text{Overhang Length Total}}{2}$$

GM Flexural Bending=Square root of (MD Bending Length×CD Bending length)

The results are expressed in cm.

CRT Absorbency

This test incorporates the following CRT equipment absorbency calculation methods The Slope of the Square Root of Time (SST 2-15) Test Method.

The Time Integrated CRTMax (TIR.005) Test Method

CRT Capacity Test Method

The SST method and CRTMax TIR method both measure rate over a wide spectrum of time to capture a view of the product pick-up rate over the useful lifetime. In particular, the SST method measures the absorbency rate via the slope of the mass versus the square root of time from 2-15 seconds. The CRTMAX TIR measures time integrated absorbency rate using a 0.005 g/sec threshold stop criteria.

Overview

The absorption (wicking) of water by a fibrous sample is measured over time. A sample is placed horizontally in the instrument and is supported by an open weave net structure that rests on a balance. The test is initiated when a tube connected to a water reservoir is raised and the meniscus makes contact with the center of the sample from beneath, at a small negative pressure. Absorption is controlled by the ability of the sample to pull the water from the instrument for approximately 20 seconds. Rate is determined as the slope of the regression line of the outputted weight vs sqrt(time) from 2 to 15 seconds.

Apparatus

Conditioned Room—Temperature is controlled from 73° F.±2° F. (23° C.±1° C.). Relative Humidity is controlled from 50%±2%

Sample Preparation—Product samples are cut using hydraulic/pneumatic precision cutter into 3.375 inch diameter circles for SST, CRT Max and 3 inch diameter circles for CRT capacity.

Capacity Rate Tester (CRT)—The CRT is an absorbency tester capable of measuring capacity and rate. The CRT consists of a balance (0.001 g), on which rests on a woven grid (using nylon monofilament line having a 0.014" diameter) placed over a small reservoir with a delivery tube in the center. This reservoir is filled by the action of solenoid valves, which help to connect the sample supply reservoir to an intermediate reservoir, the water level of which is monitored by an optical sensor. The CRT is run with a −2 mm water column, controlled by adjusting the height of water in the supply reservoir.

Software—LabView based custom software specific to CRT Version 4.2 or later.

Water—Distilled water with conductivity<10 μS/cm (target<5 μS/cm) @ 25° C.

Sample Preparation

For this method, a usable unit is described as one finished product unit regardless of the number of plies. Condition all samples with packaging materials removed for a minimum of 2 hours prior to testing. Discard at least the first ten usable units from the roll. Remove two usable units and cut one 3.375-inch (SST, CRTMax) or 3.0 inch (CRT Capacity) circular sample from the center of each usable unit for a total of 2 replicates for each test result. Do not test samples with defects such as wrinkles, tears, holes, etc. Replace with another usable unit which is free of such defects Sample Testing Pre-Test Set-Up 1. The water height in the reservoir tank is set −2.0 mm below the top of the support rack (where the towel sample will be placed).
2. The supply tube (8 mm I.D.) is centered with respect to the support net.
3. Test samples are cut into circles of 3⅜" SST, CRTMax) or 3" (CRT Capacity) diameter and equilibrated at Tappi environment conditions for a minimum of 2 hours.

Test Description

1. After pressing the start button on the software application, the supply tube moves to 0.33 mm below the water height in the reserve tank. This creates a small meniscus of water above the supply tube to ensure test initiation. A valve between the tank and the supply tube closes, and the scale is zeroed.
2. The software prompts you to "load a sample". A sample is placed on the support net, centering it over the supply tube, and with the side facing the outside of the roll placed downward.
3. Close the balance windows, and press the "OK" button—the software records the dry weight of the circle.
4. The software prompts you to "place cover on sample". The plastic cover is placed on top of the sample, on top of the support net. The plastic cover has a center pin (which is flush with the outside rim) to ensure that the sample is in the proper position to establish hydraulic connection. Four other pins, 1 mm shorter in depth, are positioned 1.25-1.5 inches radially away from the center pin to ensure the sample is flat during the test. The sample cover rim should not contact the sheet. Close the top balance window and click "OK".
5. The software re-zeroes the scale and then moves the supply tube towards the sample. When the supply tube reaches its destination, which is 0.33 mm below the support net, the valve opens (i.e., the valve between the reserve tank and the supply tube), and hydraulic connection is established between the supply tube and the sample. Data acquisition occurs at a rate of 5 Hz, and is started about 0.4 seconds before water contacts the sample.
6. The test runs for at least 20 seconds. For CRTMax test is stopped when rate of increase of water absorbed falls below 0.005 g/s otherwise test stops at 300 seconds. For CRT Capacity the test is stopped when rate of increase of water absorbed falls below 0.0015 g/s otherwise test stops at 300 secs. After this, the supply tube pulls away from the sample to break the hydraulic connection.
7. The wet sample is removed from the support net. Residual water on the support net and cover are dried with a paper towel.
8. Repeat until all samples are tested.
9. After each test is run, a *.txt file is created (typically stored in the CRT/data/rate directory) with a file name as typed at the start of the test. The file contains all the test set-up parameters, dry sample weight, and cumulative water absorbed (g) vs. time (sec) data collected from the test.

Calculating CRT Capacity g/sq inch

Capacity (g/sq in)=0.14147×Final Weight (g water absorbed)

Where 0.14147 is the inverse of the area of the 3 inch circle and this multiplier converts values to a per square inch basis Calculation of Rate of Uptake Take the raw data file that includes time and weight data.

First, create a new time column that subtracts 0.4 seconds from the raw time data to adjust the raw time data to correspond to when initiation actually occurs (about 0.4 seconds after data collection begins).

Second, create a column of data that converts the adjusted time data to square root of time data (e.g., using a formula such as SQRT( ) within Excel).

Third, calculate the slope of the weight data vs the square root of time data (e.g., using the SLOPE( ) function within Excel, using the weight data as the y-data and the sqrt(time) data as the x-data, etc.). The slope should be calculated for the data points from 2 to 15 seconds, inclusive (or 1.41 to 3.87 in the sqrt(time) data column).

Calculation of Slope of the Square Root of Time (SST 2-15)

The start time of water contact with the sample is estimated to be 0.4 seconds after the start of hydraulic connection is established between the supply tube and the sample (CRT Time). This is because data acquisition begins while the tube is still moving towards the sample, and incorporates the small delay in scale response. Thus, "time zero" is actually at 0.4 seconds in CRT Time as recorded in the *.txt file.

The slope of the square root of time (SST) from 2-15 seconds is calculated from the slope of a linear regression line from the square root of time between (and including) 2 to 15 seconds (x-axis) versus the cumulative grams of water absorbed. The units are $g/sec^{0.5}$.

Reporting Results

Report the average slope to the nearest 0.01 $g/s^{0.5}$.

Calculation of Time Integrated Rate with 0.005 g/s threshold (CRTMax TIR 0.005) CRTMax TIR.0.005, aka "time integrated rate using a 0.005 g/sec threshold", is calculated by integrating the area under the rate (g/sec, y-axis) vs. time (sec, x-axis) curve, starting at "CRT time"=0.4, until the "Time Average Rate" is 0.005 g/sec or less (referencing "Time Average Rate" beginning at CRT Time=1.4 sec).

$$\text{CRT Max TIR.0.005}=\Sigma[(CA(i)-CA(i-1))*IR(i)]+[(CA(i)-CA(i-1))*(IR(i-1)-IR(i))*0.5)]$$

Where:

i=CRT Time increment, starting at 0.4 sec, until the "CRT Time" when Time Average Rate (at 1.4 seconds and after), is equal to or below 0.005 g/sec.

CA=cumulative water absorbed (g)

IR=instantaneous rate (g/sec)

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A fibrous structure, comprising: a plurality of relatively high density wet-formed discrete elements each at least partially defined by a substantially continuous relatively low density wet-formed network that extends about an area of the fibrous structure, wherein the plurality of relatively high density discrete elements are disposed in a repeating concentric pattern defined from the inside of said pattern to the outside of said pattern by a first central relatively high density discrete element having a first area dimension, a second plurality of relatively high density discrete elements surrounding said first central relatively high density discrete element, each relatively high density discrete element of said second plurality of relatively high density discrete elements having a second area dimension, and a third plurality of relatively high density discrete elements surrounding said second plurality of relatively high density discrete elements, each relatively high density discrete element of said third plurality of relatively high density discrete elements having a third area dimension, and wherein said third area dimension is greater than said second area dimension, and said second area dimension is greater than said first area dimension.

2. The fibrous structure of claim 1, wherein each of said relatively high density discrete elements has a major axis, CDmax, and a minor axis, MDmax, and wherein the length of CDmax is greater than or equal to the length of MDmax.

3. The fibrous structure of claim 1, wherein each of said relatively high density discrete elements has a major axis, CDmax, and a minor axis, MDmax, and wherein a ratio of the length of CDmax to the length of MDmax is in the range of about 1 to 5.

4. The fibrous structure of claim 1, wherein each said repeating concentric pattern comprises from about 5% to about 30% by area said first plurality of relatively high density discrete elements, from about 30% to about 60% by area said second plurality of relatively high density discrete elements, and from about 30% to about 50% by area said third plurality of relatively high density discrete elements.

5. The fibrous structure of claim 1, wherein a major axis, CDmax, of each of said relatively high density discrete elements extends in a cross machine direction.

6. The fibrous structure of claim 1, wherein each element of said second plurality of relatively high density discrete elements is separated from adjacent relatively high density discrete elements in said second plurality of relatively high density discrete elements by a second distance and each element of said third plurality of relatively high density discrete elements is separated from adjacent relatively high density discrete elements in said third plurality of relatively high density discrete elements by a third distance which is greater than said second distance.

7. The fibrous structure of claim 1, wherein the fibrous structure is embossed.

8. The fibrous structure of claim 1, wherein the fibrous structure is uncreped.

9. A fibrous structure, comprising: a plurality of relatively high density wet-formed discrete elements each at least partially defined by a substantially continuous relatively low density network that extends about an area of the fibrous structure, wherein the plurality of relatively high density wet-formed discrete elements are disposed in a repeating concentric pattern defined from the inside of said pattern to the outside of said pattern by a first set of central relatively high density wet-formed discrete elements each having first area dimension, a second plurality of relatively high density wet-formed discrete elements surrounding said first set of relatively high density wet-formed discrete elements, each element of said second plurality of relatively high density wet-formed discrete elements having a second area dimension, and a third plurality of relatively high density wet-formed discrete elements surrounding said second plurality of relatively high density wet-formed discrete elements, each element of said third plurality of relatively high density wet-formed discrete elements having a third area dimension, and wherein said third area dimension is greater than said second area dimension, and said second area dimension is greater than said first area dimension.

10. The fibrous structure of claim 9, wherein each of said discrete elements has a major axis, CDmax, and a minor axis, MDmax, and wherein the length of CDmax is greater than or equal to the length of MDmax.

11. The fibrous structure of claim 9, wherein each of said discrete elements has a major axis, CDmax, and a minor axis, MDmax, and wherein a ratio of the length of CDmax to the length of MDmax is in the range of 1 to 5.

12. The fibrous structure of claim 9, wherein each said repeating concentric pattern comprises from about 5% to about 30% by area said first plurality of relatively high density discrete elements, from about 30% to about 60% by area said second plurality of relatively high density discrete elements, and from about 30% to about 50% by area said third plurality of relatively high density discrete elements.

13. The fibrous structure of claim 9, wherein each element of said second plurality of elements is separated from adjacent elements in said second plurality of elements by a second distance and each element of said third plurality of elements is separated from adjacent elements in said third plurality of elements by a third distance which is greater than said second distance.

14. The fibrous structure of claim 9, wherein the fibrous structure is embossed.

15. The fibrous structure of claim 9, wherein the fibrous structure is uncreped.

16. A fibrous structure which has a ratio of in-plane force to gather as measured by the GM-Flexural Bending Test to basis weight of greater than about 0.33 cm/ lbs/3000 $ft^2$ and a ratio of Z-direction compression resistance as measured by the 95 g Load Wet Caliper test to basis weight of greater than about 0.96 mils/ lbs/3000 $ft^2$.

17. The fibrous structure of claim 16, wherein said fibrous structure comprises an absorbent capacity of greater than about 0.621 g/sq in.

18. The fibrous structure of claim 16, where said fibrous structure is embossed.

* * * * *